US007052125B2

(12) United States Patent
Askren et al.

(10) Patent No.: US 7,052,125 B2
(45) Date of Patent: May 30, 2006

(54) APPARATUS AND METHOD FOR INK-JET PRINTING ONTO AN INTERMEDIATE DRUM IN A HELICAL PATTERN

(75) Inventors: Benjamin A. Askren, Lexington, KY (US); Robert L. Burdick, Lancaster, KY (US); Bill C. Chappel, Mt. Sterling, KY (US); Christopher G. Chee, Lexington, KY (US); William P. Cook, Lexington, KY (US); David M. Cseledy, Lexington, KY (US); Larry S. Foster, Lexington, KY (US); James P. Harden, Lexington, KY (US); William S. Klein, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/651,238

(22) Filed: Aug. 28, 2003

(65) Prior Publication Data

US 2005/0046651 A1 Mar. 3, 2005

(51) Int. Cl.
*B41J 2/01* (2006.01)

(52) U.S. Cl. ..... 347/103; 347/12

(58) Field of Classification Search ..... 347/9, 347/12, 13, 37, 40, 41, 42, 43, 103
See application file for complete search history.

(56) References Cited

U.S. PATENT DOCUMENTS

| | | | |
|---|---|---|---|
| 1,728,986 | A | 9/1929 | Stokes |
| 2,213,876 | A | 9/1940 | Young |
| 2,371,963 | A | 3/1945 | Pierre |
| 2,510,200 | A | 6/1950 | Thompson |
| 2,578,307 | A | 12/1951 | Hunt, Jr. |
| 2,666,807 | A | 1/1954 | Hunt, Jr. |
| 2,815,397 | A | 12/1957 | Stamps |
| 2,872,825 | A | 2/1959 | Van Doren |
| 3,864,696 | A | 2/1975 | Fischbeck |
| 3,925,790 | A | 12/1975 | Fischbeck |
| 4,040,095 | A | 8/1977 | Abrams |
| 4,050,075 | A | 9/1977 | Hertz et al. |
| 4,054,884 | A | 10/1977 | Nelson |
| 4,069,485 | A | 1/1978 | Martin |
| 4,101,018 | A | 7/1978 | Sokolowski |
| 4,157,178 | A | 6/1979 | Ollendick |
| 4,208,666 | A | 6/1980 | Paranjpe |
| 4,210,919 | A | 7/1980 | Aiba |

(Continued)

FOREIGN PATENT DOCUMENTS

| | | |
|---|---|---|
| EP | 0858896 A2 | 8/1998 |

*Primary Examiner*—Manish Shah
*Assistant Examiner*—Leonard Liang
(74) *Attorney, Agent, or Firm*—Francis Law Office

(57) ABSTRACT

An apparatus and method for ink-jet printing onto an intermediate drum in a helical pattern while correcting for image skew and aliasing. A plurality of ink-jet print heads place an image on an intermediate drum, impervious to ink, in a helical patter. To compensate for helical printing, the image is altered by nozzle placement and image manipulation to correct for skewing errors, and thereafter, the nozzle timing is adjusted to correct for aliasing. The plurality of print heads move parallel to the axis of rotation of the drum while the drum is simultaneously rotating, causing the image to be placed in a helical pattern. Once the entire image is placed on the drum, paper is rolled against the drum under pressure and the image is transferred thereto.

9 Claims, 27 Drawing Sheets

U.S. PATENT DOCUMENTS 4,216,480 A 8/1980 Buehner et al.
4,237,466 A 12/1980 Scranton
4,293,863 A 10/1981 Davis et al.
4,293,866 A 10/1981 Takita et al.
4,302,762 A 11/1981 Aiba
4,303,925 A 12/1981 Harbour, Jr. et al.
4,308,543 A 12/1981 Shultz
4,412,232 A 10/1983 Weber et al.
4,517,575 A 5/1985 Kakimoto et al.
4,538,156 A 8/1985 Durkee et al.
4,707,704 A 11/1987 Allen et al.
4,707,712 A 11/1987 Buckley et al.
4,745,487 A 5/1988 Nishikawa
4,814,798 A 3/1989 Fukae et al.
4,870,504 A 9/1989 Ishida et al.
4,897,737 A 1/1990 Shalev
4,992,890 A 2/1991 Pinard et al.
5,049,999 A 9/1991 Stemmle
5,053,791 A 10/1991 Baek et al.
5,084,735 A 1/1992 Rimai et al.
5,099,256 A 3/1992 Anderson
5,117,374 A 5/1992 Gotez
5,121,139 A 6/1992 Burke
5,335,007 A 8/1994 Choi
5,353,105 A 10/1994 Gundlach et al.
5,365,261 A 11/1994 Ozawa et al.
5,372,852 A 12/1994 Titterington et al.
5,389,958 A 2/1995 Bui et al.
5,402,156 A 3/1995 Donahue et al.
5,441,353 A 8/1995 Kim
5,448,276 A 9/1995 Hirabayashi et al.
5,456,540 A 10/1995 Jeutter
5,471,233 A 11/1995 Okamoto et al.
5,475,412 A 12/1995 Wong
5,502,476 A 3/1996 Neal et al.
5,559,540 A 9/1996 Burolla
5,576,753 A * 11/1996 Kataoka et al. ..... 347/248
5,606,350 A 2/1997 Koyama
5,607,242 A 3/1997 Suzuki et al.
5,614,933 A 3/1997 Hindman et al.
5,623,296 A 4/1997 Fujino et al.
5,640,180 A 6/1997 Hale et al.
5,668,588 A 9/1997 Morizumi et al.
5,677,719 A 10/1997 Granzow
5,714,288 A 2/1998 Vreeland, III et al.
5,750,592 A 5/1998 Shinozuka et al.
5,760,807 A 6/1998 Yamazaki et al.
5,760,808 A 6/1998 Wiedmer
5,771,054 A 6/1998 Dudek et al.
5,805,191 A 9/1998 Jones et al.
5,808,645 A 9/1998 Reeves et al.
5,812,153 A 9/1998 Watanabe et al.
5,841,456 A 11/1998 Takei et al.
5,844,584 A 12/1998 Murrphy, III et al.
5,854,648 A 12/1998 Hanabusa
5,871,292 A 2/1999 Johnson et al.
5,889,534 A 3/1999 Johnson et al.
6,068,372 A * 5/2000 Rousseau et al. ..... 347/103
6,076,922 A * 6/2000 Knierim ..... 347/103
6,394,577 B1 * 5/2002 Wen et al. ..... 347/43
6,443,571 B1 * 9/2002 Shinkoda et al. ..... 347/103
6,648,466 B1 * 11/2003 Beauchamp et al. ..... 347/103
6,648,468 B1 * 11/2003 Shinkoda et al. ..... 347/103
2004/0252175 A1 * 12/2004 Bejat et al. ..... 347/103

* cited by examiner

NORMAL NOZZLE LAYOUT, FIRING SEQUENCE

FIRING SEQUENCE MATCHES LAYOUT

NO NOZZLE PAIRS SWAPPED

1:40 LEAD ANGLE FIRING SEQUENCE

| SWAP | DELTA | PAIRS |
|---|---|---|
| ⊗ | 11 | 1 AND 20 |
| ⊕ | 9 | 2 AND 19 |
| ⊖ | 4 | 3 AND 18, 4 AND 17 |
| ⦶ | 3 | 5 AND 16 |

1:20 LEAD ANGLE FIRING SEQUENCE

| SWAP | DELTA | PAIRS |
|---|---|---|
| ⊗ | 7 | 2 AND 9, 12 AND 19 |
| ⊕ | 6 | 1 AND 10, 11 AND 20 |

PAPER SKEW ANGLE A = LEAD ANGLE

CONTROLLER SEQUENCING

APPARATUS AND METHOD FOR INK-JET PRINTING ONTO AN INTERMEDIATE DRUM IN A HELICAL PATTERN

BACKGROUND OF THE INVENTION

1. Field of the Invention

The present invention relates to a system and method for printing an image onto a drum and transferring the printed image from the drum onto a medium. More particularly, the present invention relates to an ink-jet printer with large throughput where an image is printed onto a drum in a helical manner while compensating for skewing and aliasing caused by the helical printing.

2. Description of the Related Art

Ink-jet printers typically use a carriage to move a print head across a medium, such as paper, and to print onto the medium in swaths of defined widths. After each printing pass, the carriage returns the print head to a starting position to begin the next pass, after which the medium is advanced an additional swath width. Eventually, the entire medium is printed onto by the print head. However, time is wasted upon the advancement of the medium and returning the print head to the starting position. This wasted time represents a lower potential throughput. In addition, an objectionable vibration is generated upon returning of the carriage and advancing of the medium, thus generating undesired defects in the resultant printed medium.

Therefore, what is desired is a high speed printing system that provides high resolution with little or no vibration. Recently this need has been met by laser printers. However, the cost of such printers for many business and most home users is too expensive.

The present invention solves this dilemma by introducing a nearly vibration free ink-jet printer whereby an image is printed onto a drum in a helical pattern and therefrom transferred to a medium, thereby increasing throughput. Printing in a helical pattern, however, presents impediments to high image quality. It has been discovered through experimentation that printing in a helical pattern produces skewing and aliasing. Additionally, it has been determined that the drum, the carriage moving the print head, and the nozzles on the print head should all be synchronized.

The skewing produced by printing in the helical pattern can be seen in FIGS. 9 and 11, where, depending on the orientation of the image, an edge of the image is skewed by the width of the print head swath.

Aliasing results when the skewing is corrected. Aliasing shows up as jagged lines that can be objectionable, and is most noticeable on horizontal lines. At a very regular interval, a step appears in the image where one nozzle stops firing and an adjacent nozzle continues, or one nozzle begins firing next to one that is firing continuously.

Conventional drum printers illustrate printing images onto a drum in a helical pattern but fail to address the drawbacks the present invention overcomes.

U.S. Pat. No. 4,293,863 to Davis et al. discloses helical pattern printing. Davis et al. discloses paper being mounted on a continuously rotated drum 12 and a print head 10 mounted on bars and sliding along the axis of rotation of the drum. The print head 10 may be moved in discrete steps or continuously while the drum is rotating. If the print head moves continuously, then the ink pattern is deposited in a helical set of print lines. See Davis et al., at column 6, lines 53–59. While Davis et al. discloses printing in a helical pattern, Davis et al. does not resolve the problem of image skew resulting from helical printing.

U.S. Pat. No. 5,099,256 to Anderson discloses an ink-jet printer depositing ink droplets onto a thermally conductive surface of a rotating intermediate drum. The ink is first deposited directly onto the drum and then transferred to paper. The surface material of the intermediate drum is impervious to ink and enables a 100% transfer of ink to the paper. Anderson requires that the ink be dried through heating the intermediate drum prior to transferring the ink to the paper. However, the intermediate drum does not continuously rotate while the print head is simultaneously moving and ejecting ink, as proposed in Davis et al. Instead the drum rotates a fixed amount with each pass of the print head. This results in wasted time for advancing the printhead, and unfavorable vibration due to the starting and stopping of the printhead upon advancement.

U.S. Pat. No. 5,668,588 to Morizumi et al. discloses a helical light scanning method in which a document is placed on a drum and scanned in a direction parallel to the direction of scan. Morizumi et al. appears to recognize a problem of skewing and proposes computing and adjusting an inclination angle of the light emitting elements to reduce the skewing as the light emitting elements scan across the drum. However, in an ink-jet environment the change in the inclination angle of the carriage must be controlled very closely. If the angle is off by a very small amount, the nozzles in the print head of the various colors will not line up during a single print swath. Further, the next swath starting point will also not line up.

The solution proposed by Morizumi et al. is unlike that of the present invention. The present invention proposes solving the skewing without altering the inclination angle of the print head. Additionally, the use of a ink-jet print head creates additional problems of nozzle placement and selection which are unrelated to the light scanning method of Morizumi et al.

Therefore, what is needed is a simple method and apparatus for helical printing on a rotating drum while simultaneously moving the print head and compensating for skewing and aliasing.

SUMMARY OF THE INVENTION

An object of the present invention is to provide a method and apparatus for helical printing on a rotating drum while simultaneously moving the print head and compensating for skewing and aliasing.

A further object of the present invention is to provide the above method and apparatus for helical drum printing that has a high print quality and a high throughput in an ink-jet printer.

Objects and advantages of the present invention are achieved with embodiments of a method of helical ink-jet drum printing. The method includes calculating a helical lead angle for an image to be printed, then applying a shearing algorithm to the image to compensate for the calculated helical lead angle. Thereafter, nozzles of a movable print head are selected to compensate for the calculated helical lead angle, and finally ink is deposited onto a drum in a helical pattern from the selected nozzles, synchronized with rotation of the drum.

In accordance with embodiments of the present invention, the method of helical ink-jet drum printing is further accomplished by calculating the lead angle based on the speed of rotation of the drum and a movement speed of the movable print head.

In accordance with further embodiments of the present invention, the method of helical ink-jet drum printing rotates the image prior to depositing ink.

In accordance with further embodiments of the present invention, the method of helical ink-jet drum printing rotates a medium prior to transferring the ink thereto.

In accordance with further embodiments of the present invention, the method of helical ink-jet drum printing adjusts the timing of the plurality of nozzles to compensate for the aliasing created by the shearing algorithm.

In accordance with further embodiments of the present invention, the method of helical ink-jet drum printing selects nozzles by arranging the nozzles in a plurality of columns, such that an arrangement of a first column set includes a first column of nozzles, and a second column of nozzles, with the second column of nozzles and the first column of nozzles being offset by a distance calculated from a minimum lead angle and the separation of nozzles within a column.

In accordance with further embodiments of the present invention, the method of helical ink-jet drum printing offsets the first column set and the second column set by a determination based on the calculated lead angle and the diameter of the drum.

Further objects and advantages are achieved in accordance with embodiments of the present invention by an ink-jet drum printer using a drum fabricated of a material which is impervious to ink, and, upon activation of the ink-jet drum printer, continuously rotates. An ink-jet print head, having a plurality of nozzles arranged in a plurality of columns, is movable parallel to the axis of rotation of the drum. A controller, connected to the ink-jet print head, causes the ink-jet print head, at the outset of printing, to move at a constant predetermined speed, computes a helical lead angle based on a speed of rotation of the drum and a movement speed of the ink-jet print head, and selects nozzles of the plurality of nozzles to compensate for the helical lead angle. Thereafter, as the print head moves across the drum ink is deposited on the drum.

In accordance with further embodiments of the present invention, the controller in the ink-jet drum printer further applies a shearing algorithm to an image prior to depositing the ink on the drum.

In accordance with further embodiments of the present invention, the controller in the ink-jet drum printer causes a medium to rotate prior to applying the medium to a drum to transfer the deposited ink thereto, and controls the timing of the plurality of nozzles to correct for aliasing created by the shearing algorithm.

In accordance with further embodiments of the present invention, the controller in the ink-jet drum printer applies a compression algorithm to an image prior to depositing the ink to print the image on the drum.

In accordance with further embodiments of the present invention, the ink-jet drum printer includes a tachometer to measure a speed of rotation of the drum.

In accordance with further embodiments of the present invention, the ink-jet drum printer includes an optical sensor to measure a movement speed of the ink-jet print head.

Objects and advantages of the present invention are accomplished, as noted above, by preferred embodiments using a plurality of ink-jet print heads to place an image on an intermediate drum, impervious to ink, in a helical pattern. To compensate for helical printing the image is altered by software manipulation and nozzle timing adjustment. The plurality of print heads move parallel to the axis of rotation of the drum while the drum is simultaneously rotating causing the image to be placed in a helical pattern. Once the entire image is placed on the drum, paper or another medium is rolled against the drum under pressure and the image is transferred to the paper. Helical ink-jet printing produces skewing and aliasing problems. The skewing has been corrected for by modifying the image before it is printed. By inverse shearing, through a shear algorithm, the image skew produced by the helical printing can be eliminated.

The correction of the skew creates additional aliasing problems, which can be corrected for by modifying the firing times of individual nozzles.

In accordance with preferred embodiments of the present invention as noted above, the ink-jet printer has a plurality of fixed print heads which helically deposit ink across a drum. With this arrangement, an additional problem is encountered in that each nozzle on the plurality of print heads is vertically aligned at a different angle relative to the drum. If uncorrected, this would result in printing distortions. The present invention corrects for these different alignments by accurately arranging the nozzle columns to fire the nozzles in a proper order.

BRIEF DESCRIPTION OF THE DRAWINGS

These and other objects and advantages of the invention will become apparent and more readily appreciated for the following description of the preferred embodiments, taken in conjunction with the accompanying drawings of which.

DESCRIPTION OF THE PREFERRED EMBODIMENTS

Figure 1A:
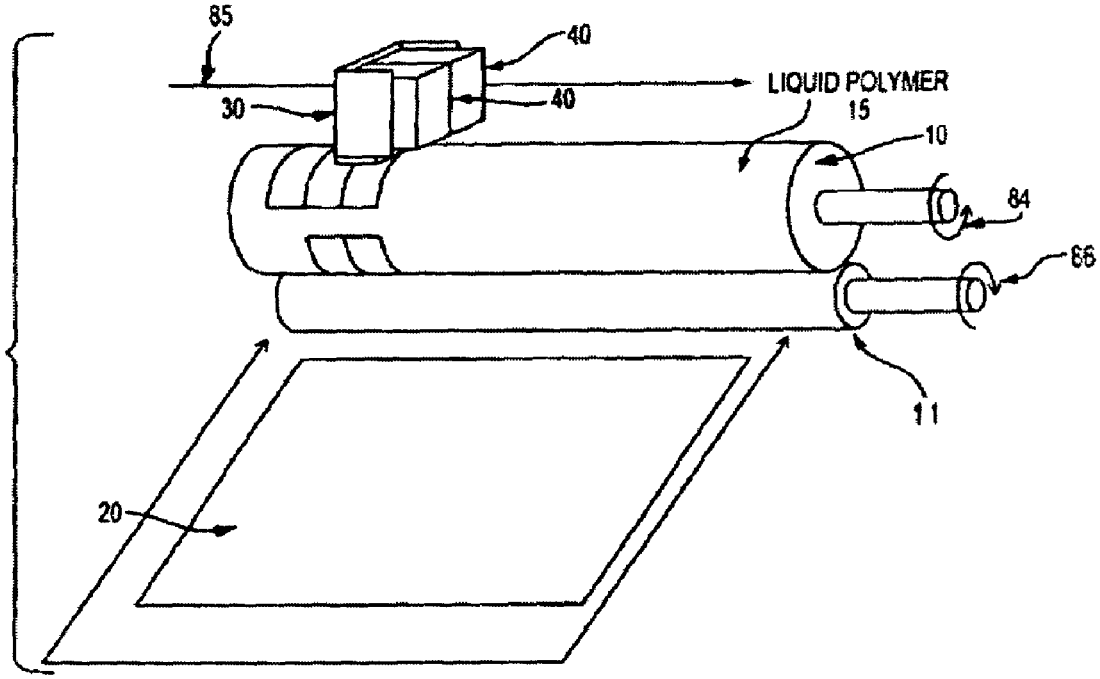
FIG. 1*a* is a diagram showing helical printing onto a drum by a print head.

Reference will now be made in detail to the preferred embodiments of the present invention, examples of which are illustrated in the accompanying drawings, wherein like reference numerals refer to like elements throughout.

In accordance with the preferred embodiments of the present invention, there is provided an ink-jet printing method and apparatus which prints an image in a helical pattern onto a drum. The printed image is thereafter transferred from the drum to a medium. The medium can include, among other things, paper, but is not limited thereto. For example, the medium could be a plastic transparency.

Overall Ink-jet Helical Drum Printing Method and Apparatus

Figure 1B:
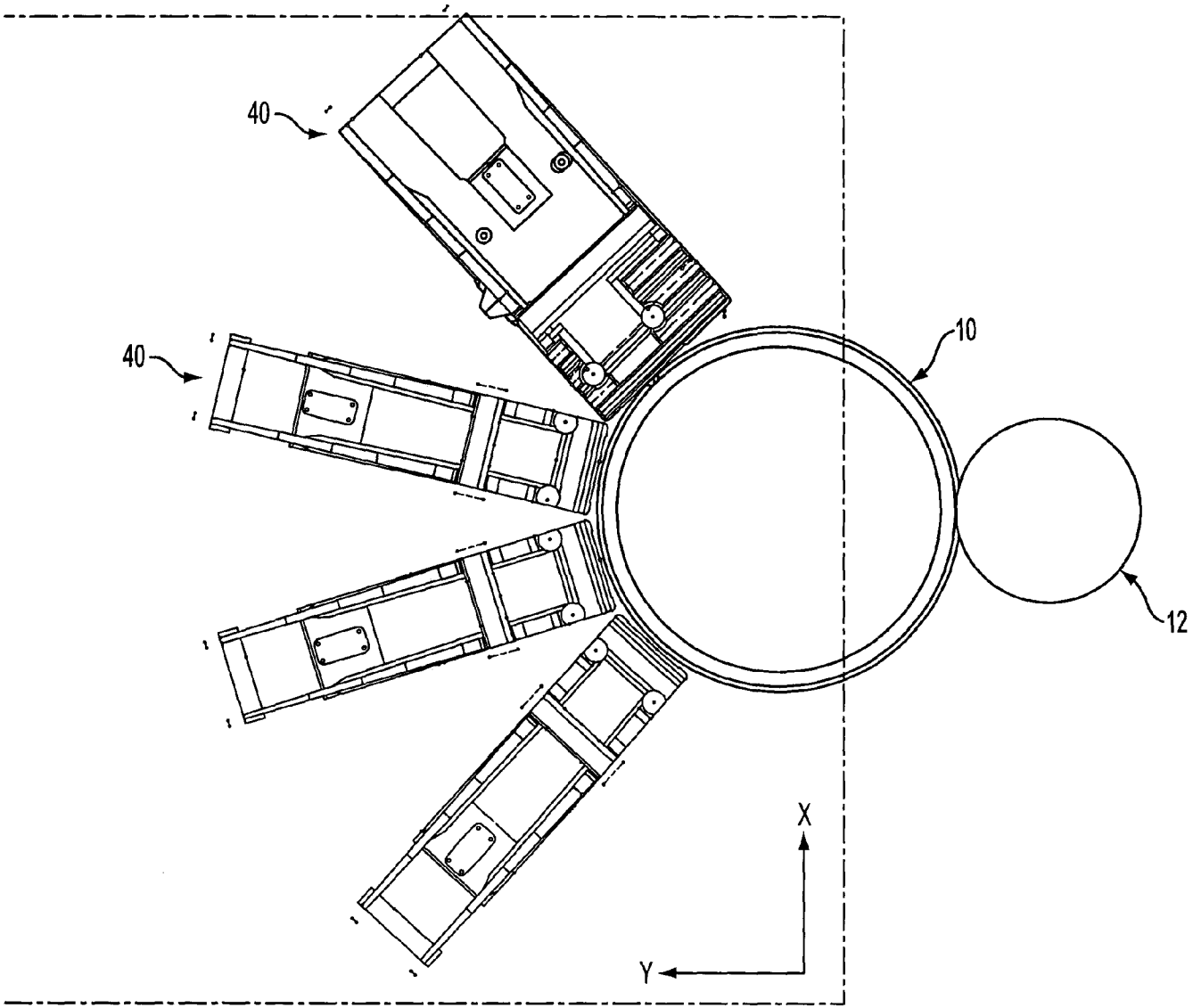
FIG. 1*b* is a diagram showing print heads arranged around a drum.

The first preferred embodiment of the ink-jet printing method and apparatus includes, as shown in FIGS. 1*a* and 1*b*, using a plurality of print heads 40 placed at different positions surrounding a drum 10. To compensate for helical printing, the image is altered by a controller and related software manipulation, and by adjusting nozzle placement. The print heads 40 move parallel to the axis of rotation of the drum while the drum is simultaneously rotating causing the image to be placed in a helical pattern. Once the entire image is deposited on the drum 10, a medium 20 is rolled against the drum 10 under pressure, such as between drum 10 and a pressure or back-up roller 11, and the image is transferred to the medium 20. Because of the ink remaining wet, less pressure is necessary to transfer the image to medium 20 than required by conventional transfer systems. Preferably, transferring of ink is performed while the ink is still wet by pressing the separate medium to the drum at a pressure between 2 and 10 psi.

Figure 2:
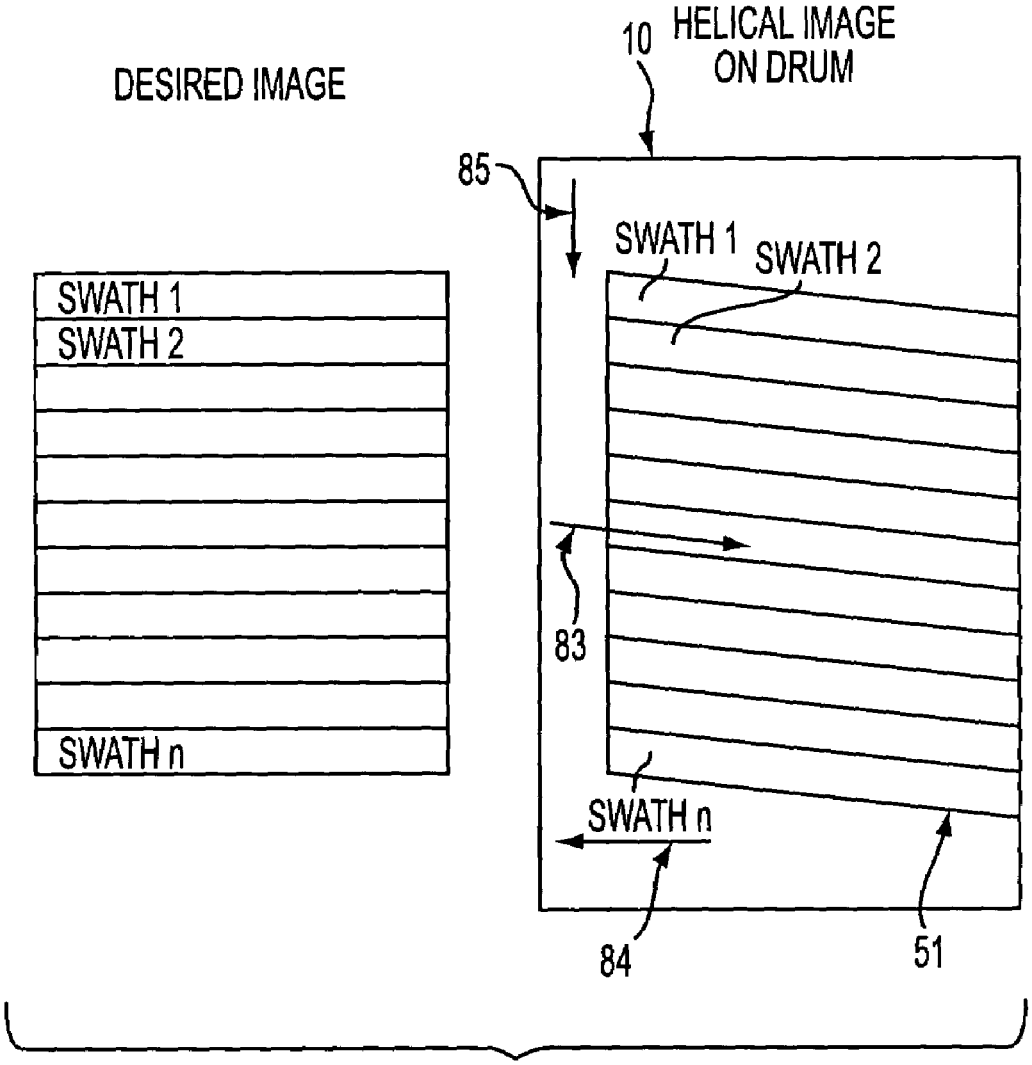
FIG. 2 is a diagram showing a desired image to be printed and the resultant image printed on the drum.

In order to achieve the greatest throughput, print head carriage 30 holding the print heads 40 follows carriage path 85 at a uniform rate while drum 10 rotates in the direction of drum rotation 84, also at a uniform rate. The overall effect is to deposit an image onto drum 10. The printed image is distorted, as shown in FIG. 2, where the image on drum 10 has been mapped onto a flat surface.

In the preferred embodiment, drum 10 is formed of a conventional urethane material. Other materials can be alternately used as long as they do not absorb the ink. A urethane material was chosen because of its high surface energy. When the drum 10 is coated with ink, a correct surface energy will prevent the ink from balling up on the drum 10, i.e., providing good wetting.

Nozzle Arrangement

As shown in FIG. 1*b*, the print heads 40 are aligned around the drum 10. Each print head has a plurality of nozzles arranged in various nozzle columns which are aligned at different angles around the drum 10 axis. As the print heads 40 follow a helical path around the drum 10, each nozzle column is offset vertically in the image with respect to the other columns.

Figure 3:
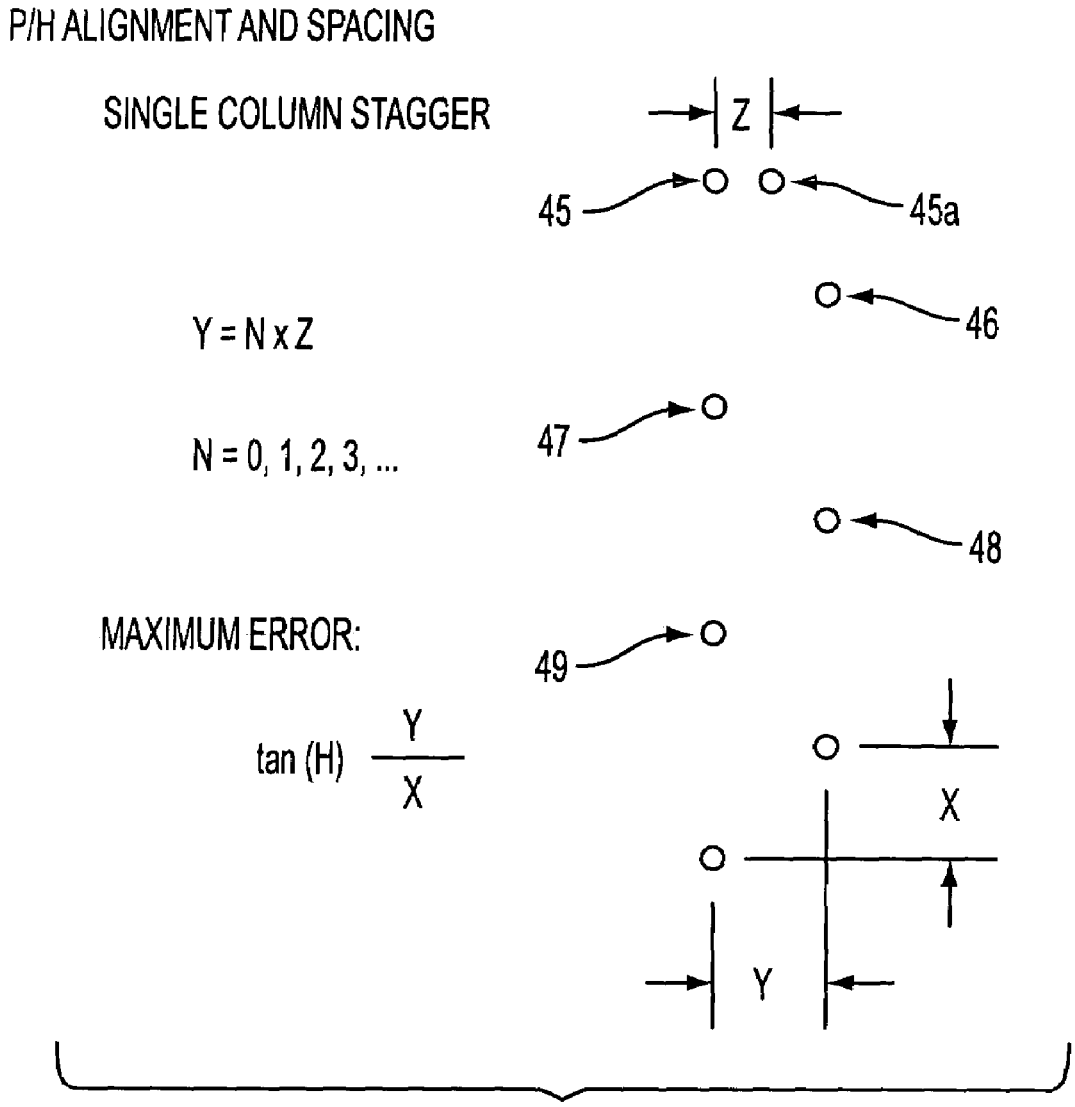
FIG. 3 is a diagram showing print head alignment and spacing of the nozzles thereon.

The nozzle columns must be carefully constructed to align with the helical path and must be adjusted to fire in a proper order corresponding to the input image. FIG. 3 shows one such nozzle column, where the nozzles of that column are staggered in two sets separated by distance Y. For example, in FIG. 3, a first set on the left side includes nozzles 45, 47, and 49, and a second set on the right side includes nozzles 46 and 48. Nozzle 45 of the left set moves distance Z to its next firing position or location 45*a*. The distance Y may be necessary for nozzle plate or heater cavity design at high resolutions. Distance Y must be an integer multiple of the addressability distance Z in the scan direction of the print head, such as 1, 2 or 3 times Z. Distance X sets the vertical addressability of the print head.

The lead angles of interest need to be defined in order to analyze the errors and problems with the nozzle placement. A convenient maximum lead angle H to use is 1:10 (5.7°), which occurs when using a print swath of 1" and a drum circumference of 10". The minimum lead angle L of interest in such a system could be a factor of 8 smaller, or 1:80 (0.72°). Because the generated image is skewed from the nozzle column by the lead angle, the ink drops generated by the right set of nozzles will be slightly misplaced from their proper location when printing along a helical path. Assuming that the nozzle plate is created to print a perfect image with no lead angle (e.g., the carriage is stationary while the drum rotates and the print head prints in FIG. 1*a*), the maximum error placement is (H×Y)X. If the set of nozzles on the right were adjusted to compensate for half of the maximum lead angle, the maximum error would be (H×Y)(2×X). For instance, if X is 1/600" and Y is 1/600", the maximum error is 1/20 or 5% of X for the maximum lead angle H of 1:10. This error is minimized by reducing distance Y and moving one set of nozzles (i.e., the set with nozzle 46 with respect to the set with nozzles 45 and 47) to compensate for half of the maximum angle H.

Figure 4:
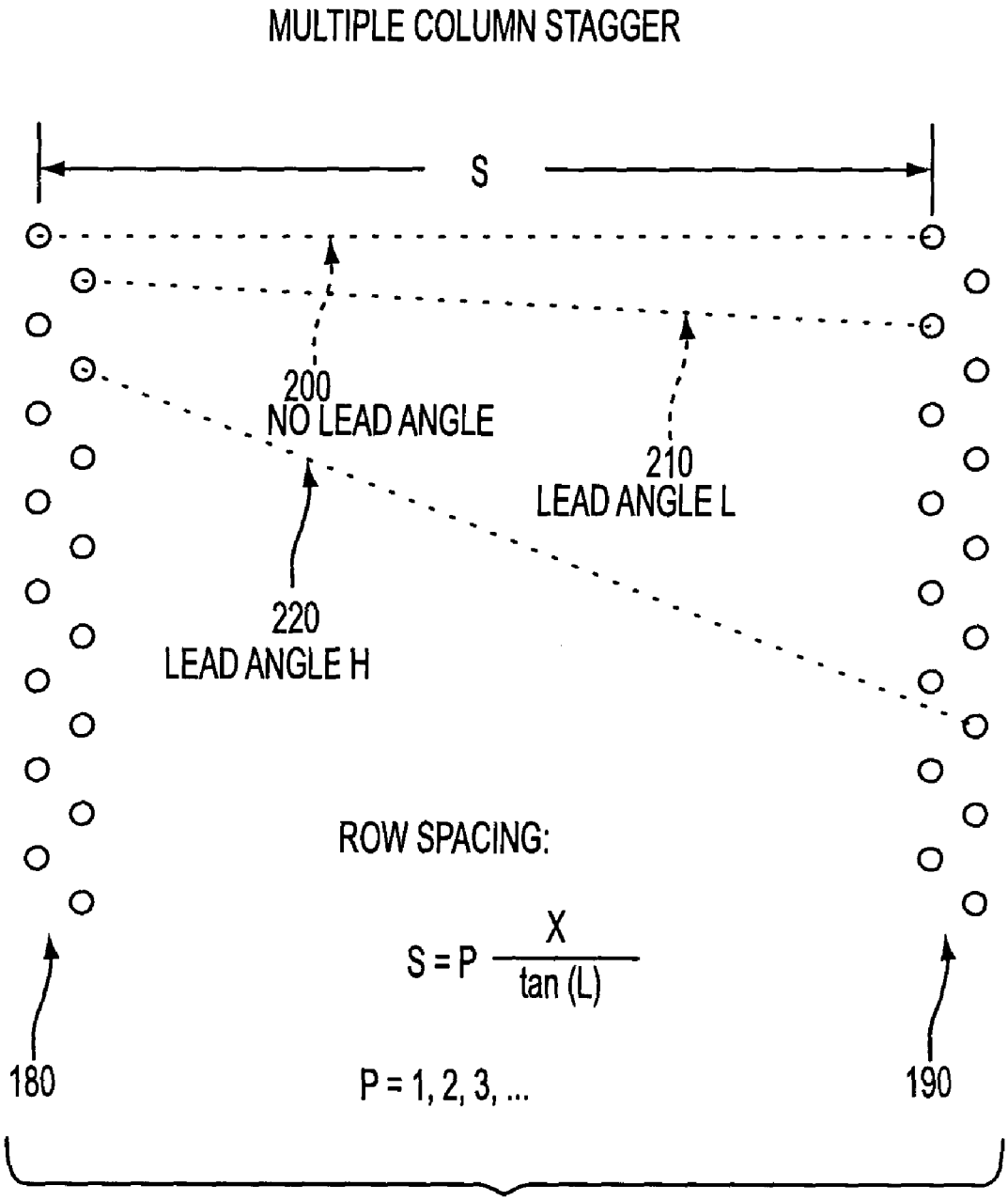
FIG. 4 is a diagram showing the spacing of multiple columns of nozzles for proper pixel alignment.

FIG. 4 shows two columns of nozzles 180 and 190 separated by distance S. Distance S is a multiple of the scan direction print head distance Z, such as 60 or 80 times Z. Dotted line 200 shows the relative alignment of the two columns when a lead angle is not generated. Dotted line 210 shows the relative alignment of the two columns when the minimum lead angle L of interest is being used. At that angle L, line 210 passing through a nozzle in column 180 must also pass through a nozzle in column 190, as shown. In this case, the line 210 passes through a nozzle offset by one location. The offset for a minimum lead L angle could be set to any integer offset P. The distance S is (P×X)/tan (L), where distance X is shown in FIG. 3. Distance S for an integer offset P of 1 and a distance X of 1/600" and a minimum lead angle L of 1:80 is 80/600, or 2/15. If the distance X is not a multiple of the distance Z, the minimum lead angle L may be adjusted to make distance S a multiple of distance Z. For example, if distance X is 1/600" and distance Z is 1/800", the minimum lead angle L could be set at 1:60 instead of 1:80, making distance S equal to 60 times distance Z. All other lead angles must also have the nozzles line up, such as for the maximum lead angle H, shown as dotted line 220 in FIG. 4. In this case, the nozzles in column 180 are offset by eight from those nozzles in column 190. This arrangement forces a relationship between the various lead angles of interest. If all potential lead angles A are a multiple of the minimum lead angle L, the nozzles will always line up.

When the nozzles are designed and laid out as shown, the column to column alignment correction can be accomplished by a controller sequence, i.e., in the printer driver on a host PC or in the printer microcode as the image is generated, based on commands from the host PC. The data, which is to be directed to each print head nozzle column, is offset or moved within the image by an integer number of pixels (picture elements), depending on the lead angle A which is to be used while printing. The combination of single column nozzle placement correction (FIG. 3) and multiple column nozzle alignment (FIG. 4) makes it possible to compensate for the print head alignment problem. The nozzle alignment technique shown can easily be extended to multiple columns per color and/or multiple colors.

Drum Circumference Equals a Multiple of Swath Width

Figure 5:
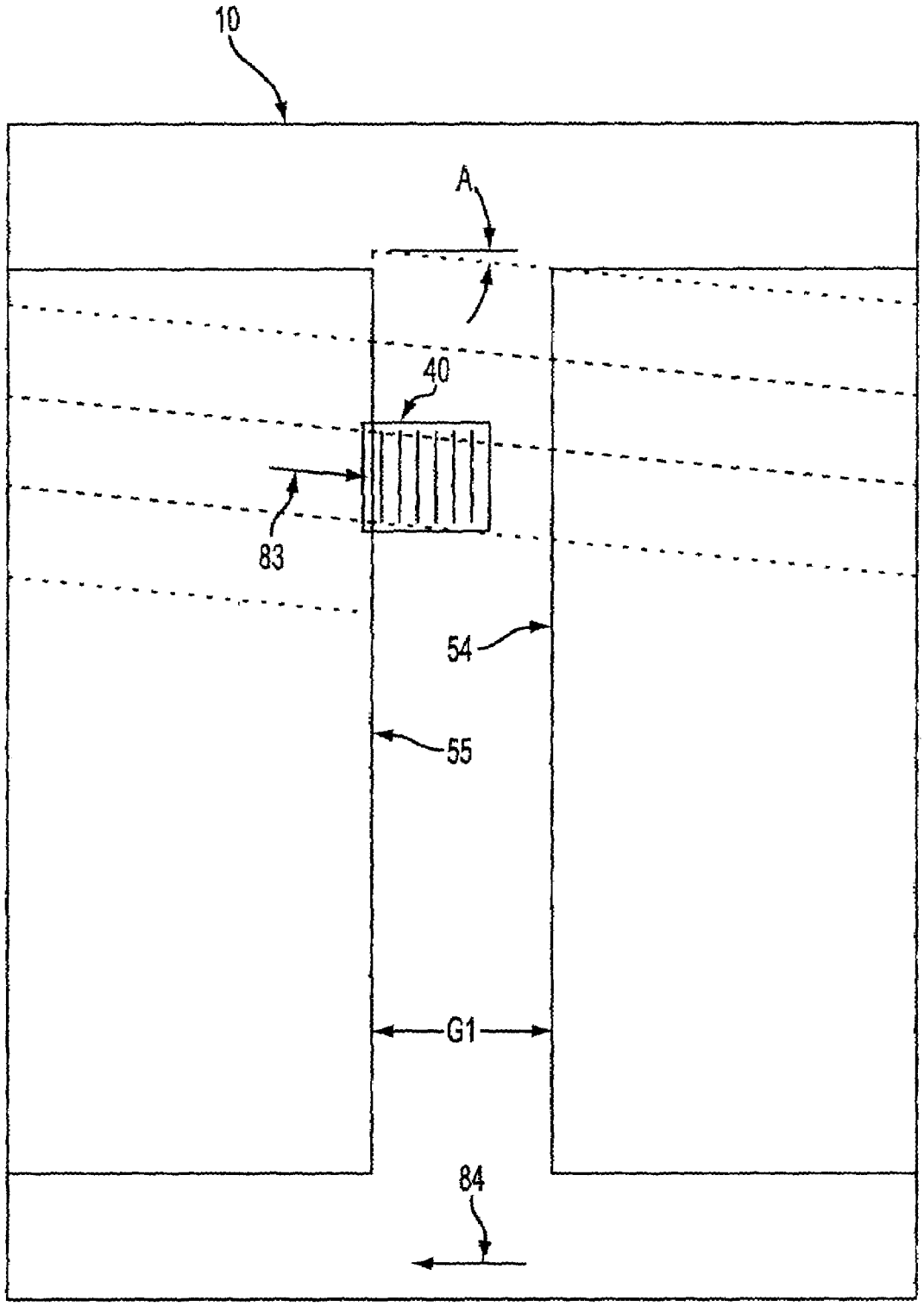
FIG. 5 is a diagram showing the print head as it moves across the gap between image edges.
Figure 6:
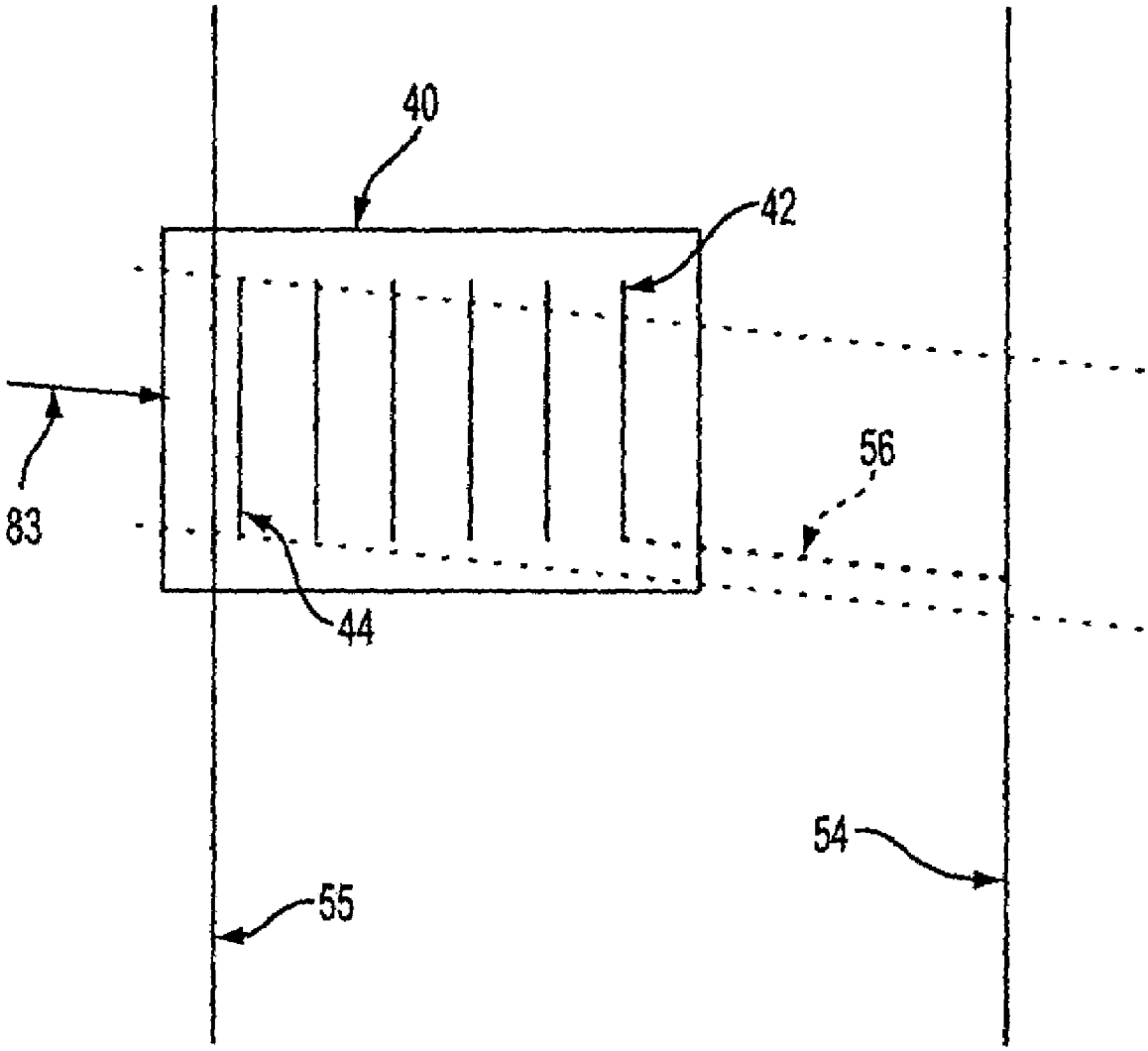
FIG. 6 is a diagram showing a detailed view of the print head as it moves across the gap between image edges.
Figure 7:
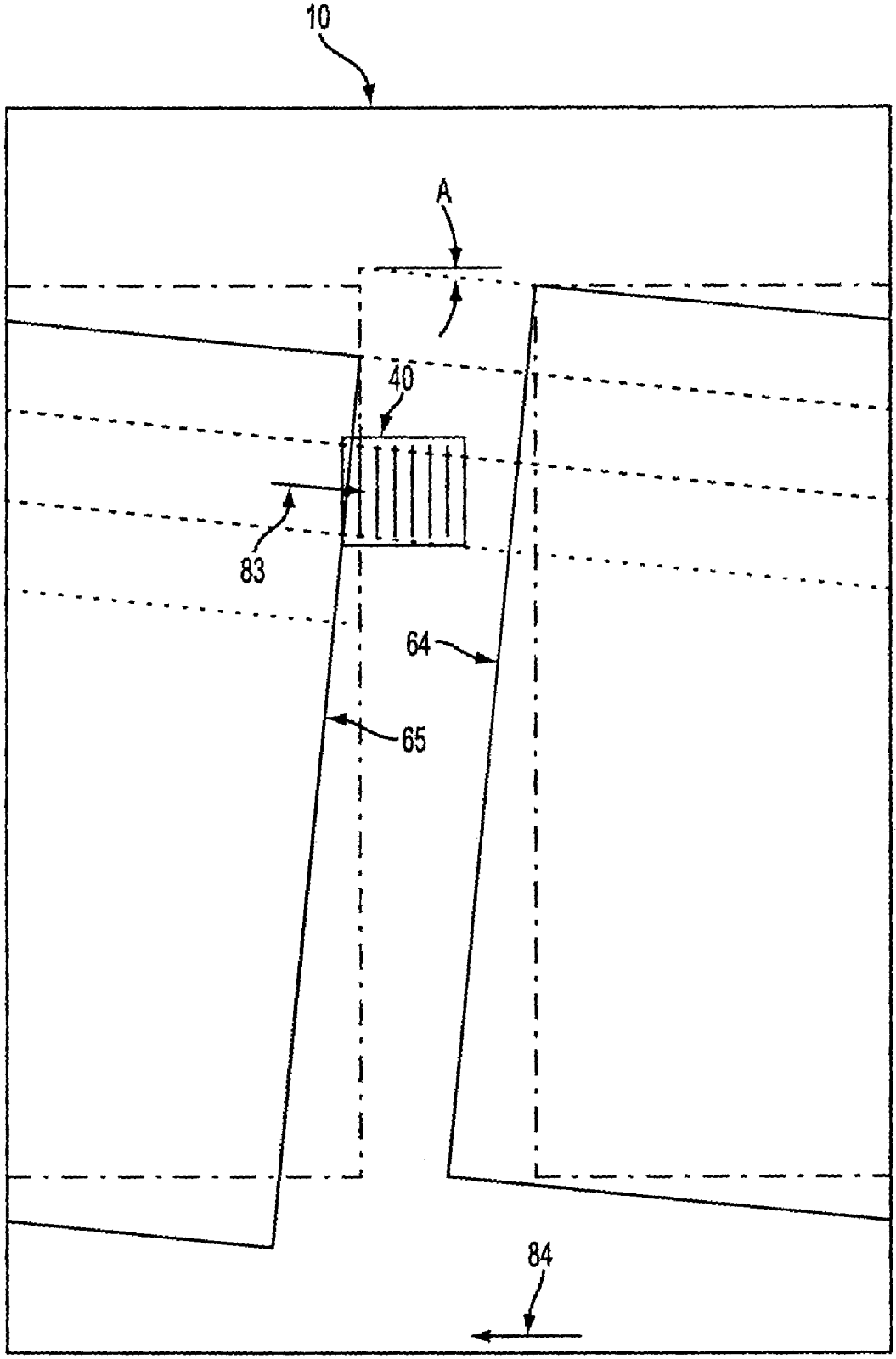
FIG. 7 is a diagram showing the print head as it moves across the gap between image edges when an image has been rotated.
Figure 8:
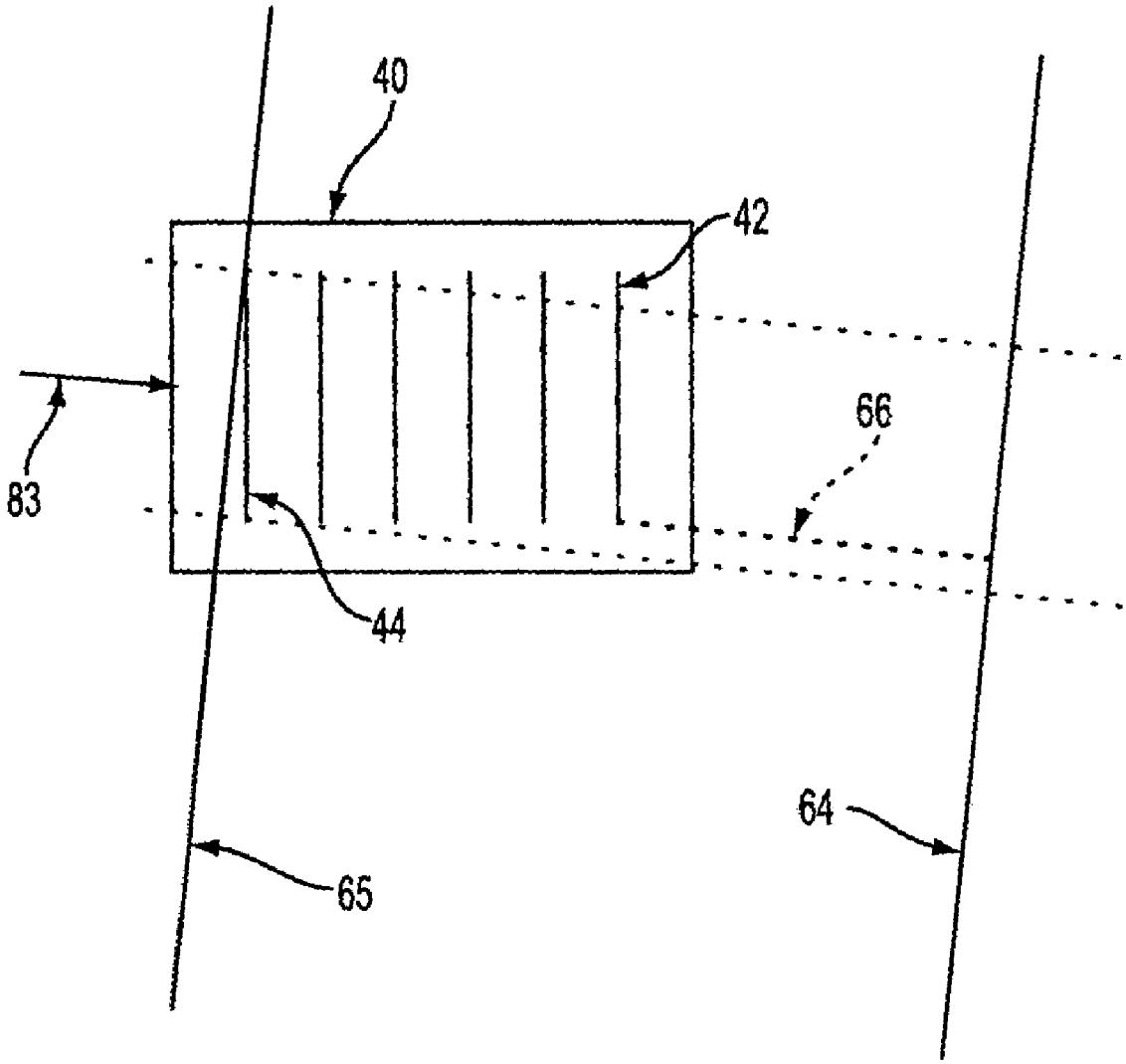
FIG. 8 is a diagram showing a detailed view of the print head as it moves across the gap between image edges when an image has been rotated.

A separate, but related, issue is the relationship between the swath width and the drum circumference. FIG. 5 shows the print heads 40 as they move along print head path 83 across the gap between image trailing edge 55 and leading edge 54. In particular, all of the nozzle columns fit within the gap, thereby enabling image adjustments between passes. FIG. 6 shows the same position of the print heads 40 illustrated in FIG. 5, but in more detail. The last nozzle column 44 is just completing one swath at trailing edge 55, and the first nozzle column 42 is following path 56 to leading edge 54 in the next swath. The circumference of drum 10 is designed to be a multiple of the swath width to achieve the desired lead angles A. If the length of path 56 is long enough, the circumference design constraint can be relaxed. The lead angle is still fixed and the error is corrected during the transition across path 56. Larger drum circumferences give more design flexibility by increasing the length of path 56, but at the cost of reducing throughput. The length of path 56 can also be increased by minimizing the separation between the first nozzle column 42 and the last nozzle column 44. Similar to FIGS. 5 and 6, FIGS. 7 and 8 show the same gap analysis with leading edge 64 and trailing edge 65 and path 66, except that the image has been rotated on the drum to reduce the aliasing defect. The analysis of drum circumference versus swath width is the same, except that the gap on the drum shrinks slightly due to the image rotation. This is better exemplified by FIG. 13 where gap G2 represents the rotated image gap between edges, and G3 represents the minimum gap between the leading and trailing edges.

FIG. 1*b* shows a different printhead arrangement around a drum, in which the nozzle column separation is greater than the image gap G1 of FIG. 5. With this arrangement, no image adjustment is possible during the interval that a printhead is over the gap, since the printheads are active in image generation on the drum. In FIG. 1*b*, the circumference of drum 10 is again designed to be a multiple of the swath width.

Correcting for Skewing

Figure 9:
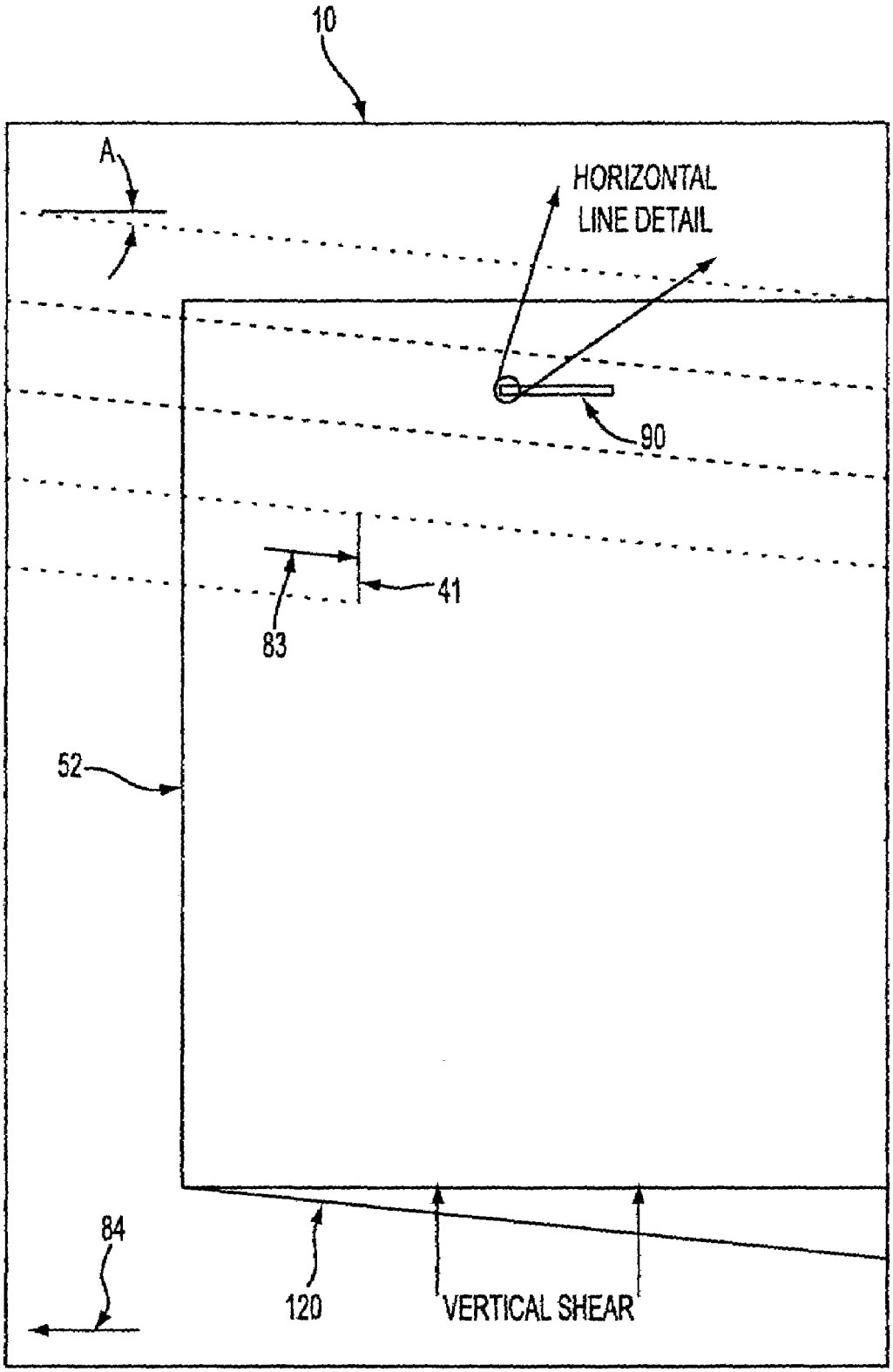
FIG. 9 is a diagram showing the vertical skewing produced by helical printing.
Figure 11:
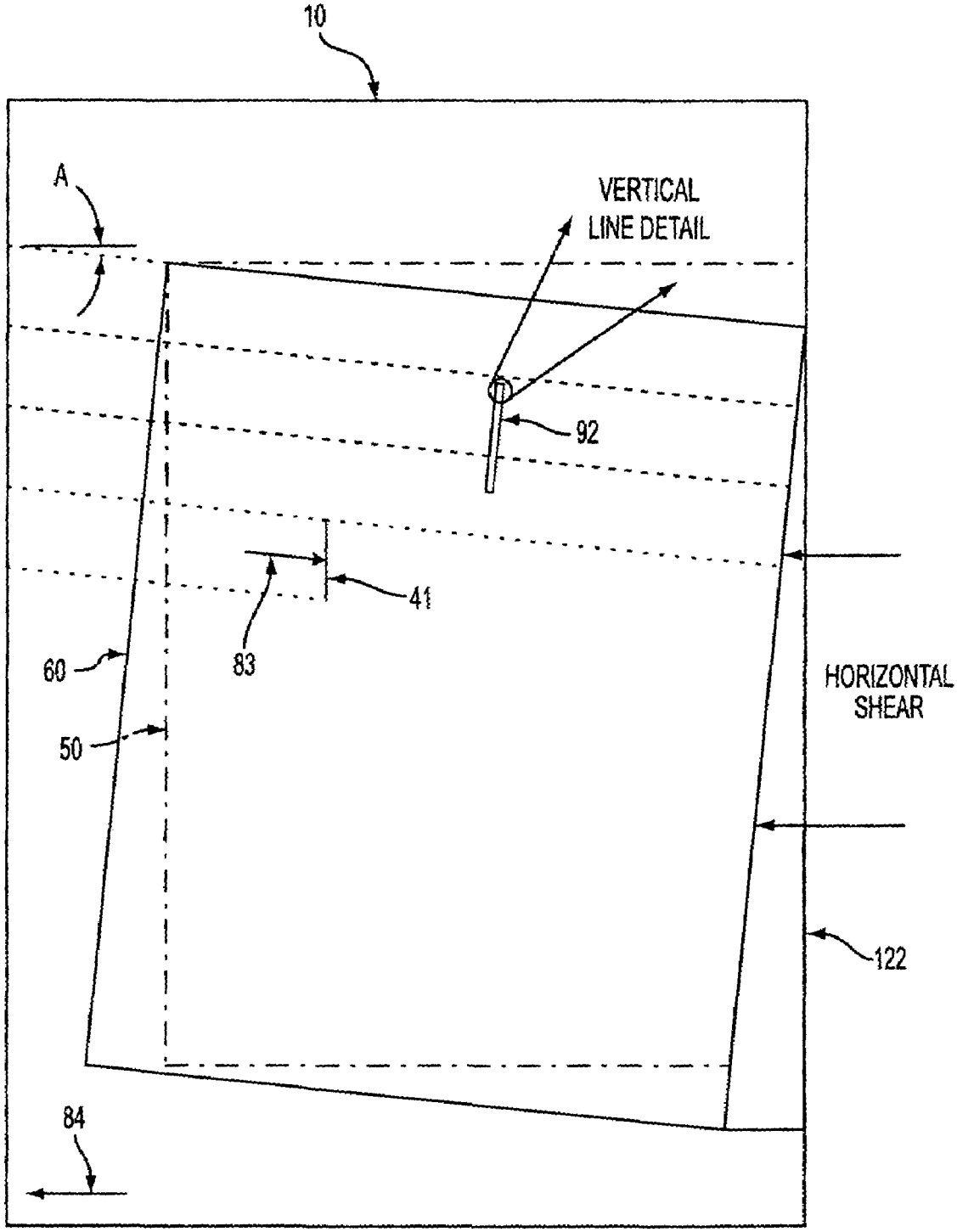
FIG. 11 is a diagram showing the horizontal skewing provided by helical printing when the image is rotated.

Printing in a helical pattern produces a skew as shown in FIGS. 9 and 11, the vertical and horizontal shear, respectively. Skew is preferably corrected by way of an inverse transformation of the image before it is printed onto drum 10. Therefore, the image can be transformed to compensate for the skew that will be produced by the helical printing.

A vertical shear algorithm is used to remove vertical skew 120 by transforming the image prior to printing on the drum 10. The vertical shear algorithm, as shown in FIG. 9, simply moves image data integer pixel locations in memory vertically before the data is printed. The distance moved is proportional to the lead angle A and the distance from the leading edge of the image. At an angle of 1:10, the data is moved up 1 pixel for each 10 horizontal pixels. A single column of nozzles 41 in print heads 40 follow the dotted lines for sequential swaths across the image, resulting in a corrected image. The lead angle A is the angle between horizontal and the print head path 83 when the drum rotation 84 and carriage path 85 are combined. The jagged image of FIG. 4 results from this correction. The nozzle spacing between nozzles in FIG. 3 sets the step height. The lead angle A sets the distance between steps.

Figure 10:
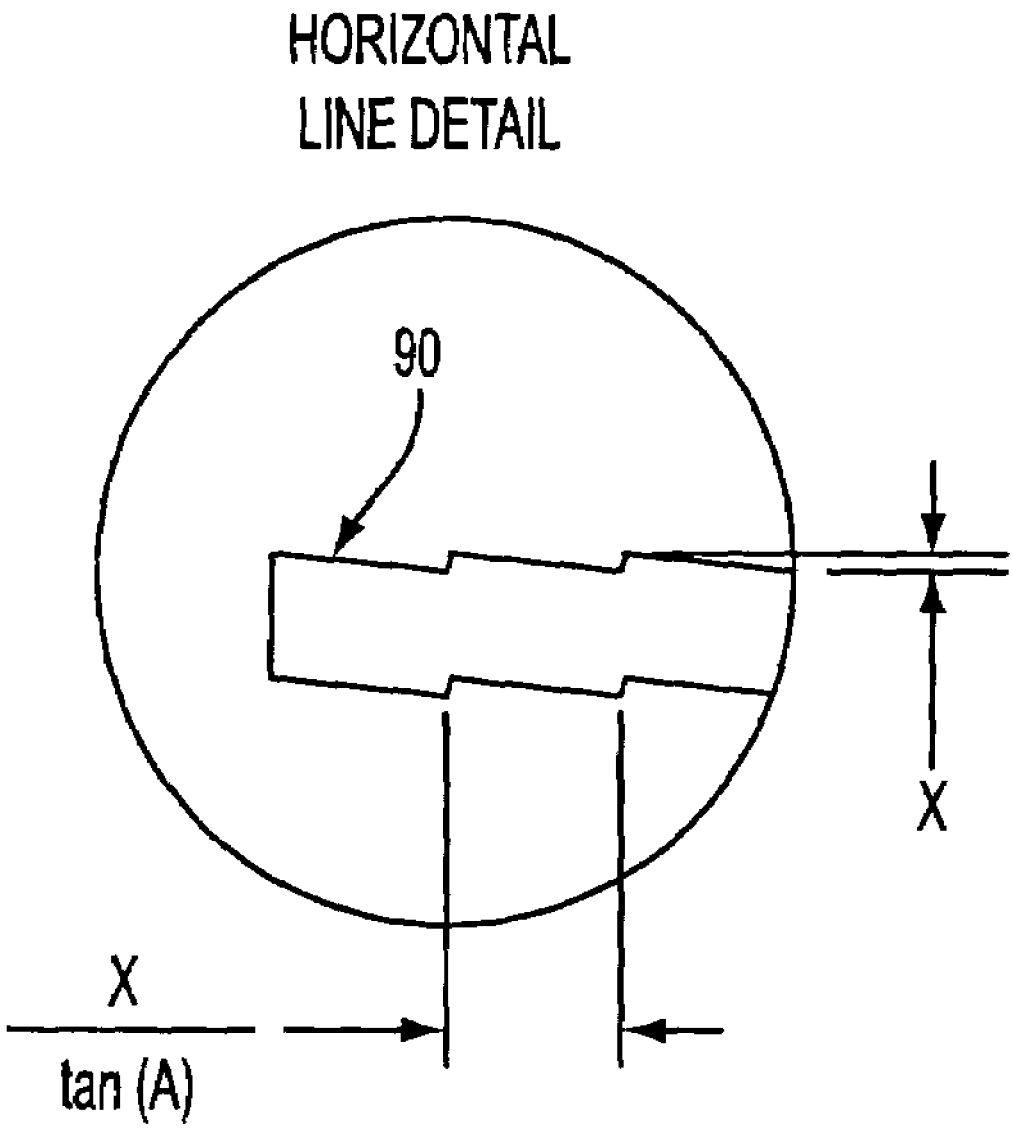
FIG. 10 is a diagram showing horizontal line detail of FIG. 9 exemplifying the aliasing effect.

Preferably, the aliasing, as shown by the general horizontal line 90 in FIG. 10, is not corrected. At the resolutions of 300×300 dpi, 300×600 dpi, 600×600 dpi, or 1200×1200 dpi, the aliasing is not particularly noticeable for normal viewing distances.

Aliasing Correction

If the resulting print quality as described above in the first preferred embodiment is not acceptable, then a second preferred embodiment can encompass the properties of the first preferred embodiment, but additionally correct for aliasing generated from the skew correction. In the second embodiment, the image is rotated on the drum, the medium is rotated correspondingly, a shearing algorithm is performed, and a timing of the nozzles is modified, as explained below.

Rotate Image

Figure 12:
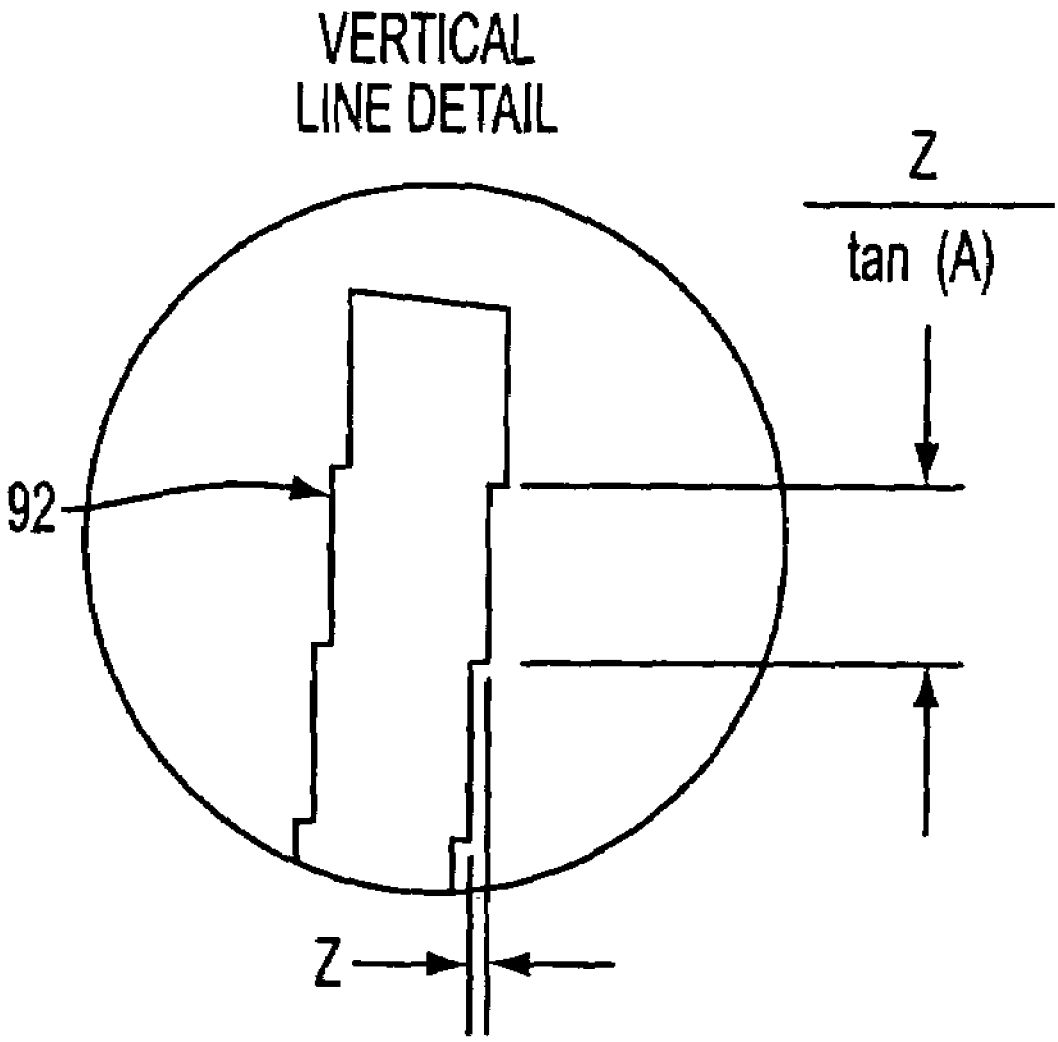
FIG. 12 is a diagram showing vertical line detail of FIG. 11 exemplifying the aliasing effect.

In particular, the image is rotated on the drum 10 using a different shear correction on the original image 50 as shown in FIG. 11. The image bottom is moved to the left with respect to the top, resulting in a proper rectangular image. The image 60 on the drum is rotated from the original image 50, so that horizontal lines are now completely free from aliasing errors. That is, a single nozzle from the column of nozzles 41 is used to define the top or bottom of any horizontal element in the image 60. However, the aliasing problem is now present on vertical lines. FIG. 12 shows a detailed view of a generally vertical line 92 where the problem is visible. The spacing between horizontal ink drops of distance Z (see FIG. 3) now defines the aliasing step, while lead angle A still sets the separation between steps. Frequently the distance Z is smaller than the nozzle gap of distance X, so the aliasing problem is immediately reduced from the previous first preferred embodiment while still maintaining the highest possible system throughput. However, this technique creates several problems.

The first problem is that the image is not aligned with the print medium as expected. The image top is rotated from horizontal as discussed earlier, and the leading edge is rotated by an equal amount across the drum. Further, the print medium and drum image should be aligned properly, which will be addressed in a later section. Second, the proper shear effect 122 should be created in the original image 50, and the print head print window around the drum 10 should be controlled to generate a rectangular image on the drum, even though the image is rotated on the drum surface. Third, the aliasing should be reduced or eliminated to produce an image quality equivalent to that produced by existing printers. Finally, the image should be expanded slightly in both dimensions.

Shear Correction Horizontal

Figure 13:
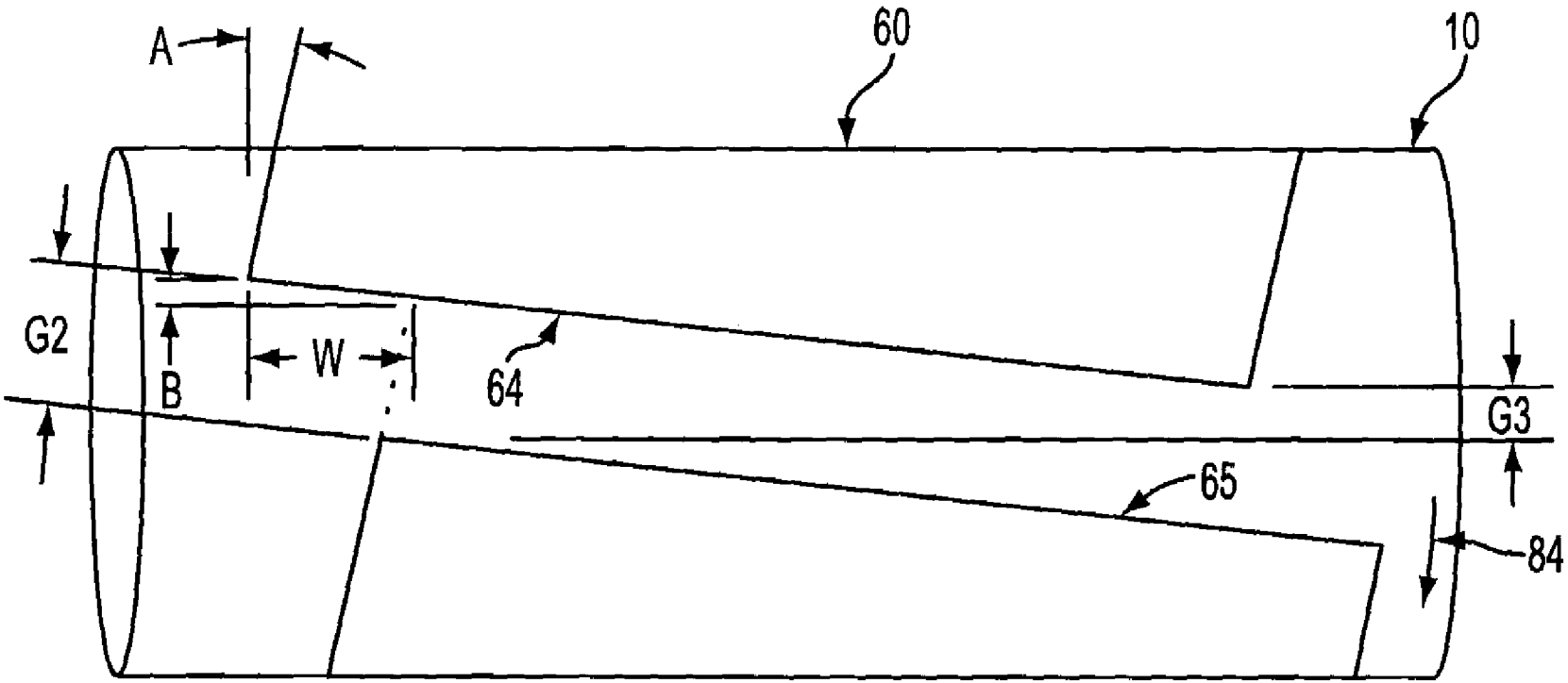
FIG. 13 is a diagram showing a helical image on a drum when an image is rotated.

In order to generate image 60 on drum 10, as illustrated in FIG. 11, two corrections should occur. First, the image data within a print swath should be sheared to the left at the same lead angle A, as described earlier. At a lead angle A of 1:10, the data is moved left one pixel for each ten vertical pixels. If the distance Z is smaller than the nozzle spacing of distance X the data can be moved left by a fractional pixel over a range of fewer vertical pixels. For instance, if distance Z is 1/1200" and the nozzle spacing X is 1/600", the data is moved left 1/1200" for every five vertical pixels. This advantage of horizontal over vertical addressability immediately reduces the aliasing problem by a factor of 2. This image modification allows for the printing of a single swath of the image shown in FIG. 11. FIG. 13 shows the same image 60 wrapped around the drum 10.

Secondly, the starting location of each swath must be adjusted to finish the entire image. The starting location for the leading edge 64 moves a distance B for each revolution of drum 10. At lead angle A of 1:10, and swath width W of 1", distance B is equal to 0.10". Of course, the two corrections could be merged into a single correction algorithm if the controller memory size is large enough.

Adjust Nozzle Timing

Modifying the firing times of individual nozzles can further reduce the image aliasing problem. In order to discuss this technique, an understanding of the nozzle placement is required. If there are many nozzles in each print head, active circuitry in the heater chip (not shown) is used to reduce the number of connections. The drive electronics (not shown) enable the nozzles in groups, using address lines, to select the active nozzle group and, using data lines, enable or disable each heater (not shown) in the selected nozzle group. The nozzles in each group are spaced apart by an equal distance on the print head. Because the print head 60 moves a small distance between firing each set of heaters, the nozzles in each set are slightly offset in the scan direction from the previous set. The firing sequence and nozzle offset make a particular nozzle plate design necessary, as shown in FIG. 14.

Figure 14:
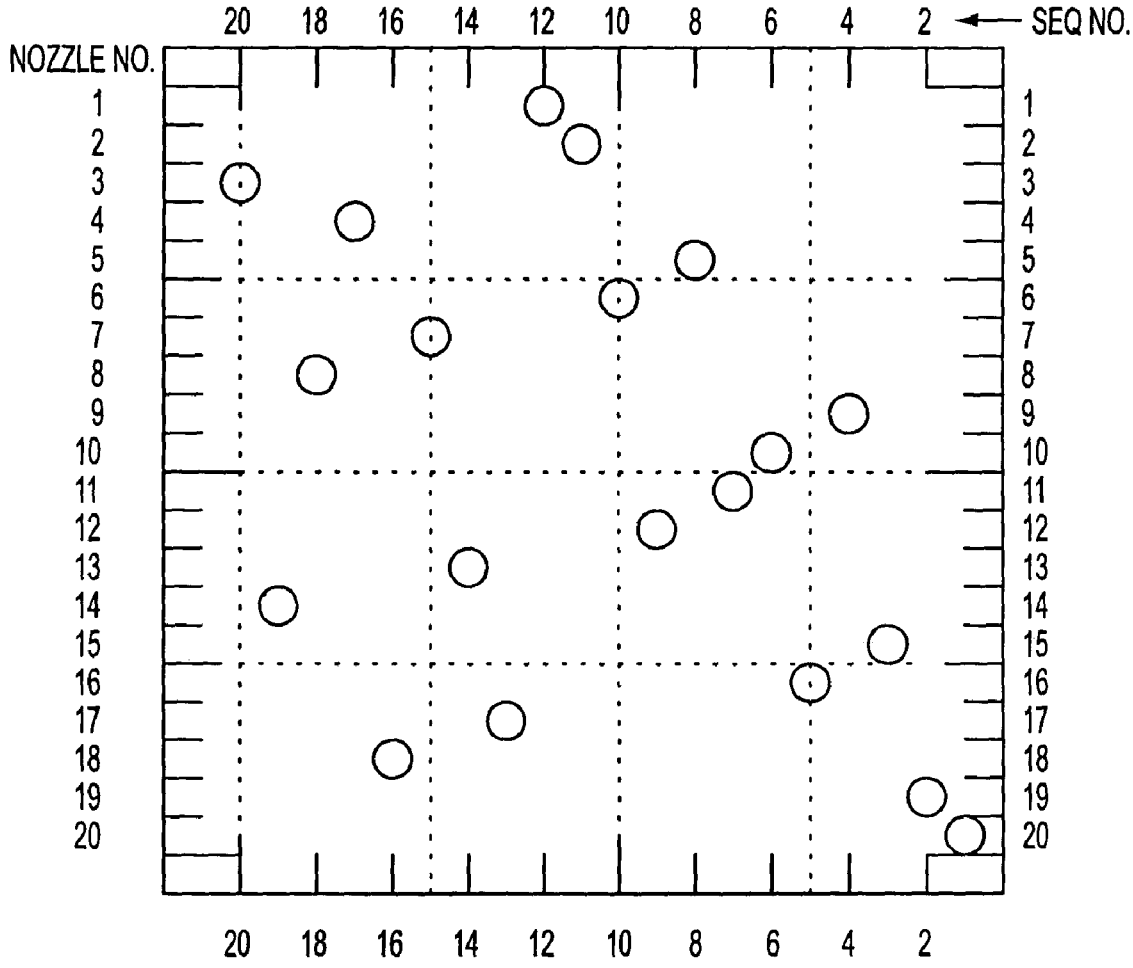
FIG. 14 is a diagram showing the firing sequence of print head nozzles where nozzle pairs are swapped.

As illustrated in FIG. 14, the labeling of "Nozzle No." represents which group each set of nozzles belongs to, and "Seq No." represents the sequence in which a nozzle group is fired. The pattern illustrated in FIG. 14 is repeated in identical fashion for the length of the print head. The firing sequence number does not usually correspond with the nozzle group number since a sequential firing order according to nozzle group numbers creates problems with the fluid dynamics of the system.

FIG. 14 is not drawn to scale. The spacing between the first firing sequence, i.e., nozzle group 20, and last firing sequence, i.e., nozzle group 3, is less than the horizontal addressability Z of the print head, such as 1/1200". The spacing between nozzle groups. i.e., between nozzle group 1 and nozzle group 2, is equal to the vertical addressability X of the print head, such as 1/600".

Figure 15:
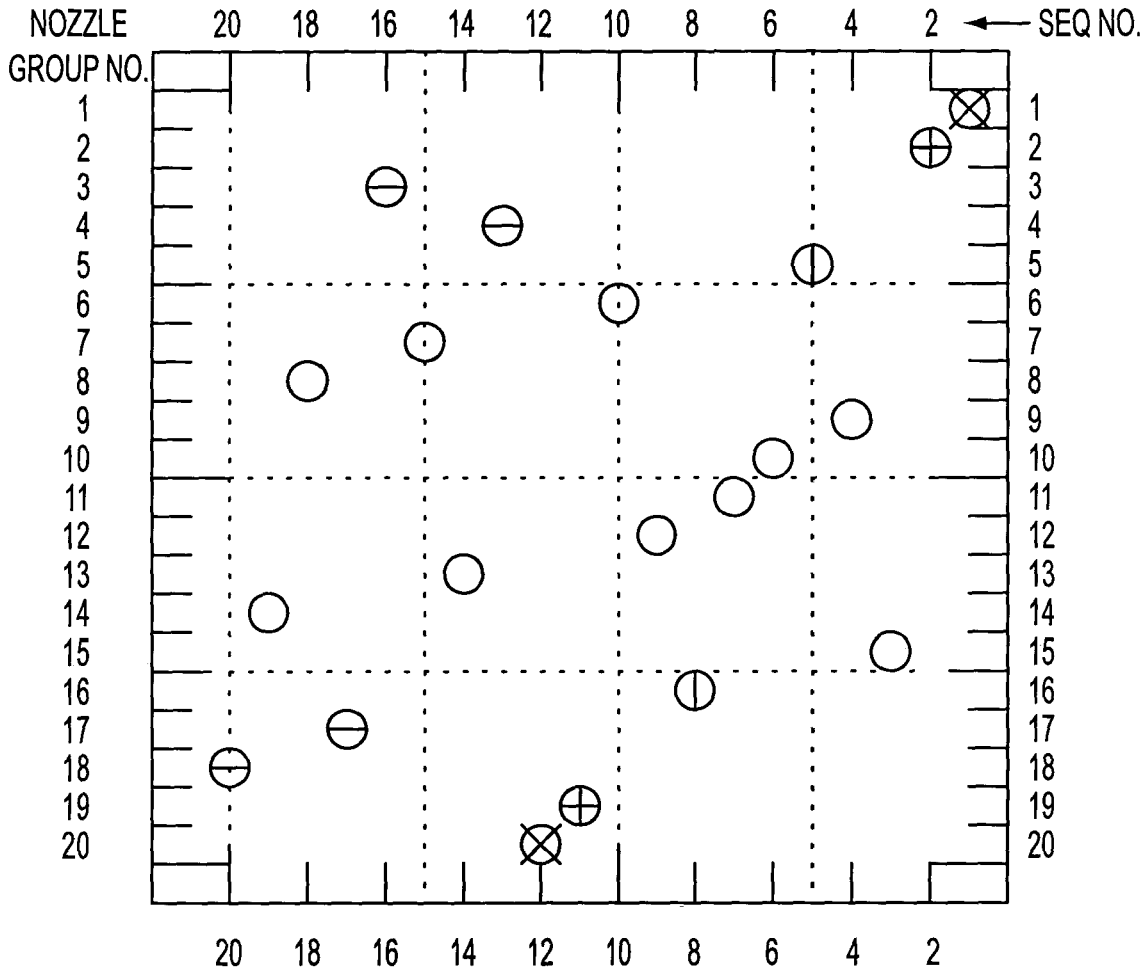
FIG. 15 is a diagram showing the firing sequence of print head nozzles corresponding to a shear angle 1:40.
Figure 16:
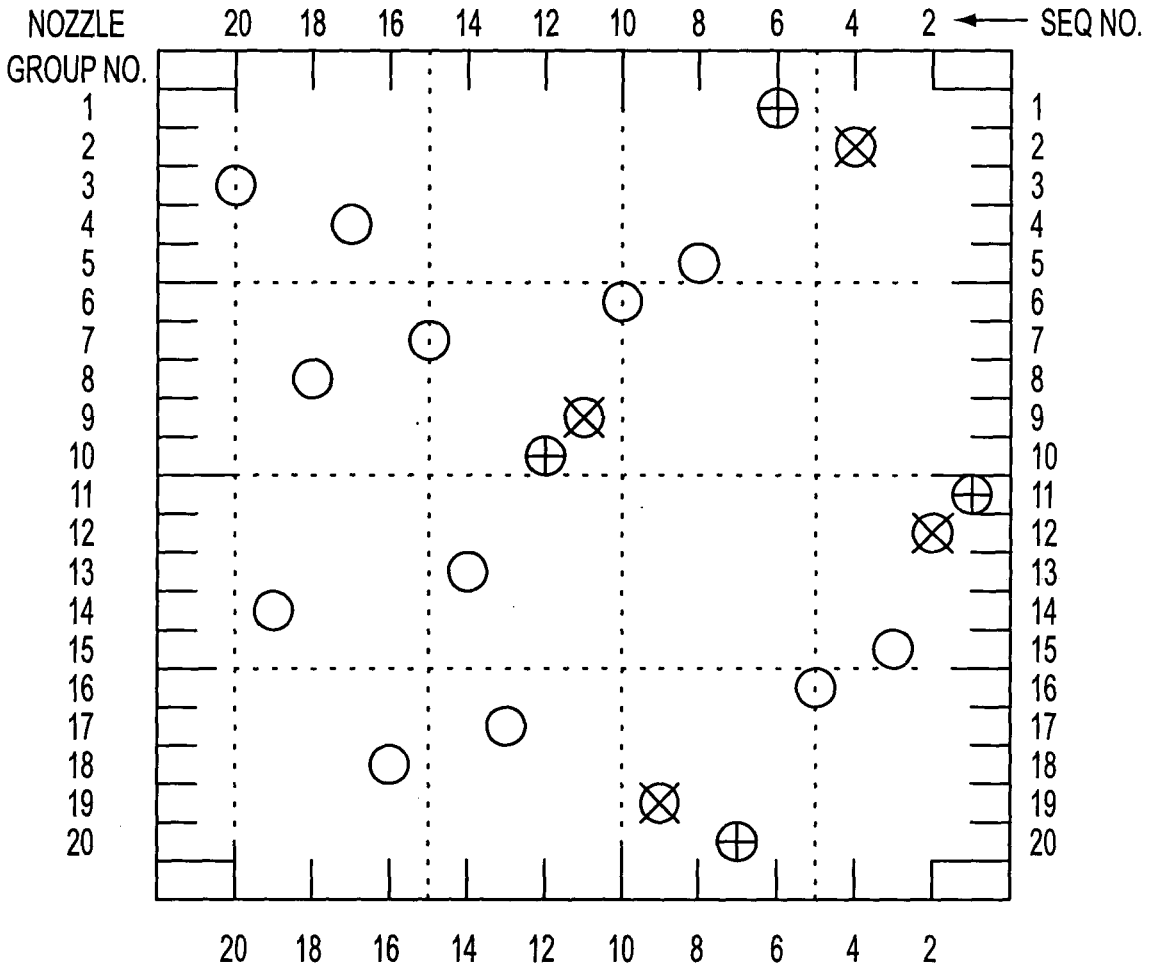
FIG. 16 is a diagram showing the firing sequence of print head nozzles corresponding to a shear angle 1:20.
Figure 17:
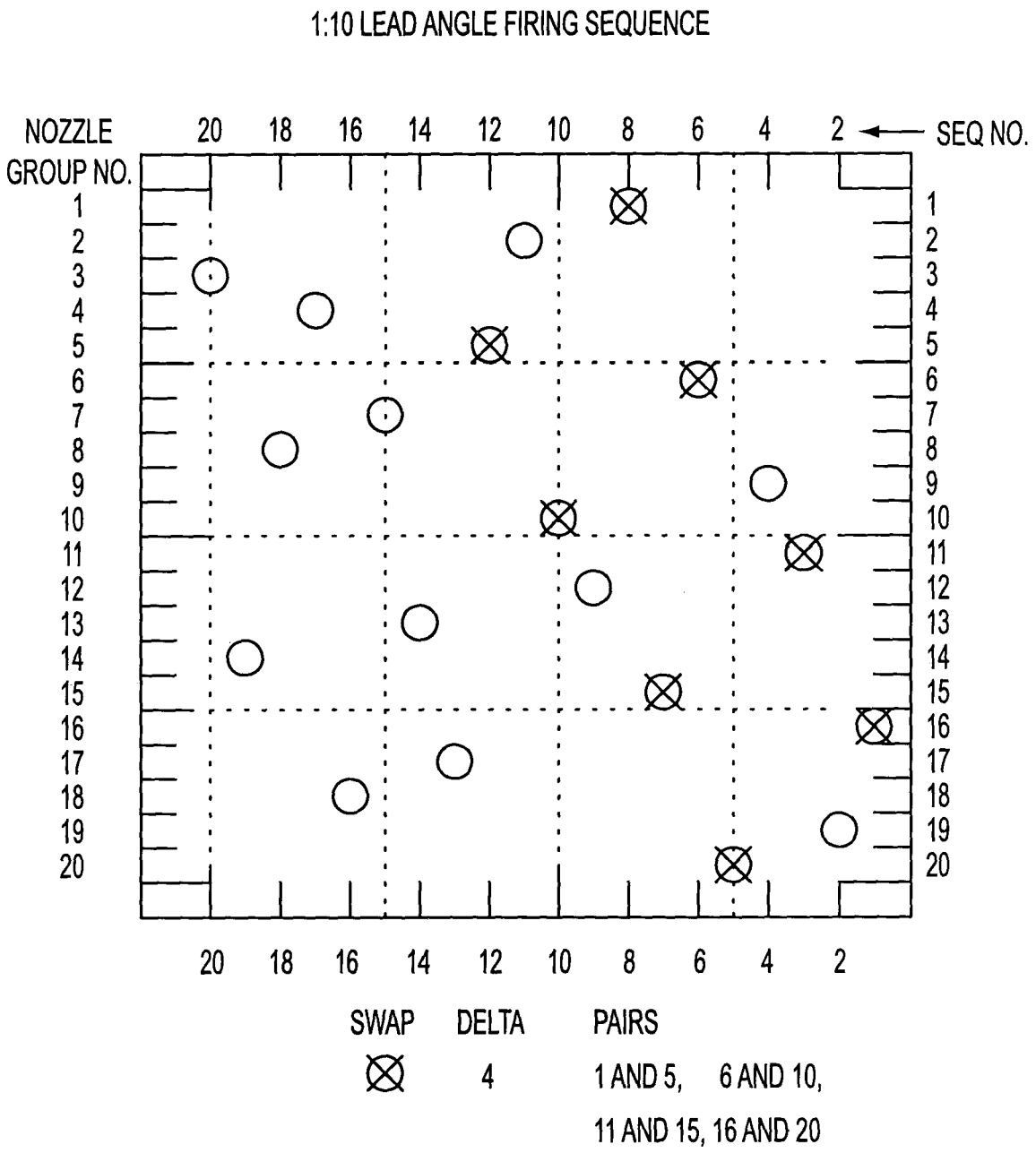
FIG. 17 is a diagram showing the firing sequence of print head nozzles corresponding to a shear angle 1:10.

With this background of nozzle placement and firing, the possibility of changing firing sequences, in order to improve the vertical aliasing shown in FIG. 12, will now be discussed. Again, referring to FIG. 14, consider the case when the firing sequence of nozzles nos. 1 and 20 are switched. Nozzle no. 1 would fire eleven time periods early, while nozzle no. 20 would be delayed by the same amount. This would be advantageous if there were an aliasing problem that could be reduced by advancing nozzle no. 1 and delaying nozzle no. 20. In a similar method, the firing sequence of nozzle nos. 2 and 19 could be swapped. However, the firing sequence of nozzle no. 1 does not have to be swapped with nozzle no. 20. As seen in FIG. 16, the firing sequence of nozzle no. 1 could be swapped with nozzle no. 10 which is offset by six firing periods, or with nozzle no. 5 which is offset by four firing periods, as shown in FIG. 17. The differing offset resulting from a swap of sequence firing between two nozzle groups is shown in FIGS. 15–17 by the designation "DELTA," where, for example in FIG. 15, the "DELTA" for swapping of firing sequences of nozzle group 1 and nozzle group 20 would be 11, as each nozzle group is now offset by 11 sequence steps in comparison with their initial firing sequences. By careful selection of nozzle locations, several useful patterns can be designed that could help resolve aliasing problems. FIGS. 15, 16 and 17 show three possible firing sequences for the nozzle groups that would help alleviate aliasing problems.

FIG. 15 shows the firing sequence where nozzle nos. 1–5 are swapped with nozzles nos. 20–16, respectively. The different nozzles that have changed sequence timing are illustrated for easy identification by different reference symbols shown under the label "SWAP." This new firing sequence helps correct image aliasing where the input data was sheared from the vertical by one horizontal space for every twenty vertical pixels. The horizontal space may be 2 of the vertical space, corresponding to a shear angle of 1:40 (1.4°). Thus, if the data of original image 50 was sheared at an angle of 1:40, and the horizontal steps in the algorithm occurred at locations that lined up at every nozzle no. 1 across the print head, then the modified firing sequence of FIG. 15 would greatly improve the aliasing problem.

In a similar manner, FIG. 16 shows a firing sequence that corresponds to a shear angle of 1:20, and FIG. 17 shows the sequence for a shear angle of 1:10. No nozzle firing sequence changes are made for the minimum angle of 1:80.

By following these new firing sequences, the aliasing problems created by shearing the original image can be reduced. FIGS. 14 through 17 are shown as examples. Many similar patterns could be envisioned which would have similar results. It should also be understood that the relationship between drum circumference and swath size discussed earlier also affects the number of nozzles in each firing group.

Image Size Correction

One final correction that should be made to finish generating image 60 on drum 10 is illustrated in FIG. 11. The image size is expanded both horizontally and vertically by 1/cos (lead angle A). For the maximum lead angle H of 1:10, the expansion is 0.5%. The original image must be compressed to compensate for this problem. The information to be printed, which is in vector form, is corrected by simply modifying the vectors before generating the final image. Information supplied in image form needs to be compressed in both dimensions by well-known algorithms. If the image is small or the lead angle A is small, no correction may be needed.

Rotation of the Medium

Figure 18:
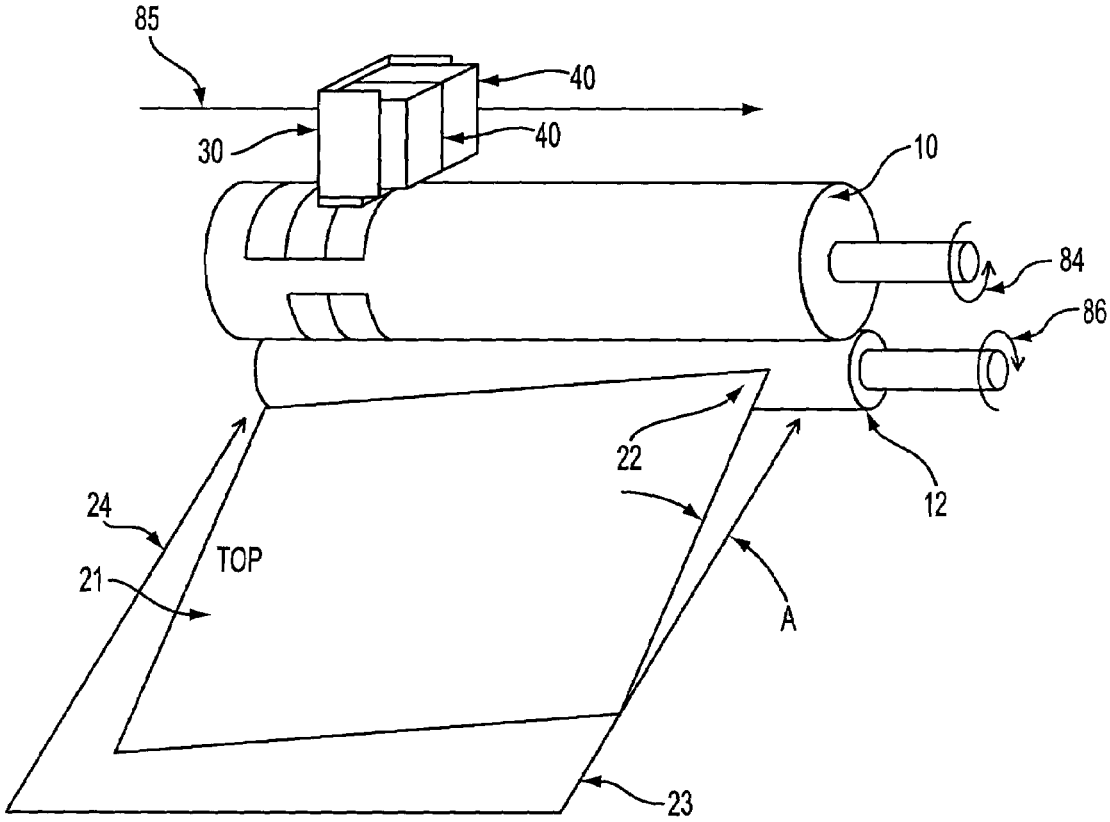
FIG. 18 is a diagram showing helical printing onto a drum by a print head where the medium has been rotated by a lead angle.
Figure 19:
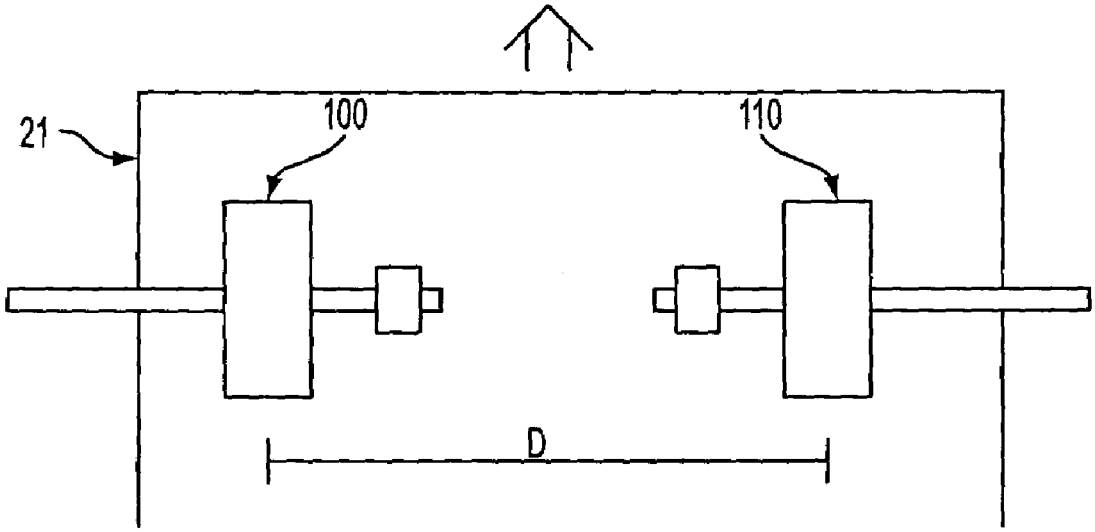
FIG. 19 is a diagram showing a drive mechanism to rotate the medium.

As discussed above in the second preferred embodiment, the medium and the image printed onto the drum 10 needs to be aligned. In FIG. 18, drum 10 rotates one revolution while print head carriage 30 moves one swath width along the axis of the drum 10. Print heads 40 create the image on the drum. Medium 21 is transported from the source tray aligned with lines 23 and 24, which are in planes normal to the rotational axis of drum 10. The medium 21 is rotated with respect to line 23 to lead angle A to match the lead angle on the drum 10. When the image creation on the drum is completed, the medium is driven forward between the drum and backup roller 11 rotating in the direction of backup roller rotation 86. Corner 22 is the first contact point between the drum 10 and backup roller 11. Backup roller 11 may be lowered Other means and methods of rotating medium 21 with respect to drum 10 and backup roller 12 will be obvious to those skilled in the art. For instance, medium 21 could be held on a tray prior to the image transfer point, and the entire tray could be rotated by a fixed amount to achieve the correct orientation. Another possibility is to hold the paper path fixed and rotate the drum 10 and backup roller 12 with respect to the paper path. These techniques have the disadvantage of being more complicated and expensive than the preferred means and method shown in FIG. 19, though they might yield a more precise rotation angle.

Additional Preferred Embodiments

In a third preferred embodiment, apparatus and method of the first and second preferred embodiments are controlled in view of a high resolution rotary tachometer. The third embodiment employs a high resolution rotary tachometer for drum 10. The resolution of the printing system is optimally equal to the print resolution determined by distance Z or an integer factor different, so that the print resolution can be easily created from the tachometer information. The print head timing information is then derived from the tachometer data. The drum 10 rotates at a uniform rate during the entire process. An optical grating and sensor (or equivalent) tracks the carriage travel along carriage path 85 of drum 10, with the resolution closely related to the vertical resolution determined by distance X.

The carriage movement control system uses the drum tachometer and vertical grating sensor to achieve the correct carriage movement along carriage path 85, and horizontal versus vertical position synchronization. Regardless of the lead angle A, the same sensor information can be used for drum 10 and carriage movement control as well as print head timing. When a helical path is followed, the effective nozzle column separation is increased. The drum velocity should increase to compensate for this change. Additionally, the carriage velocity along the drum axis should increase as well to achieve the correct lead angle.

Figure 20:
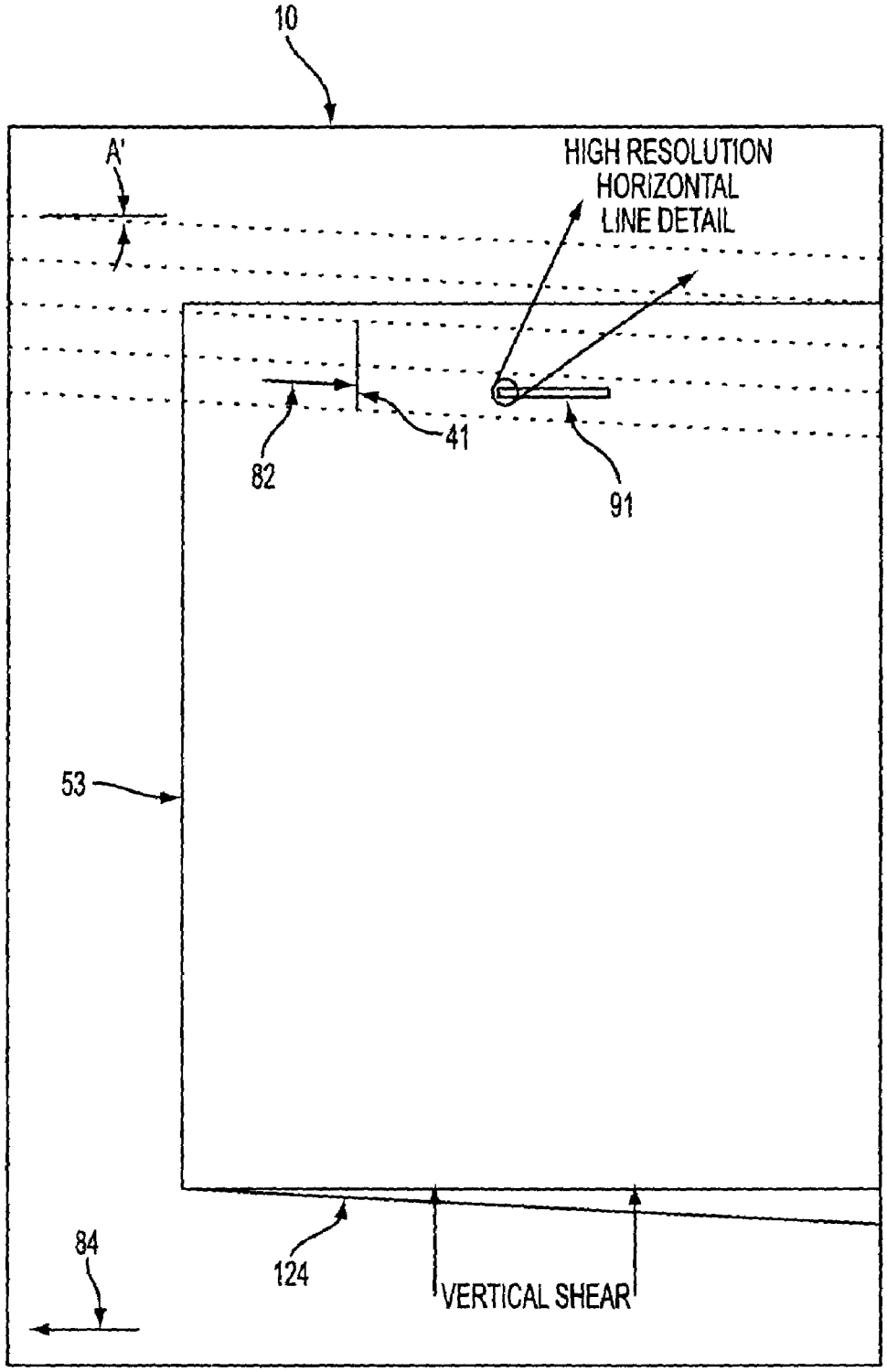
FIG. 20 is a diagram showing the movement of the print head across the image when increasing the number of passes that the print head makes around a drum.
Figure 21:
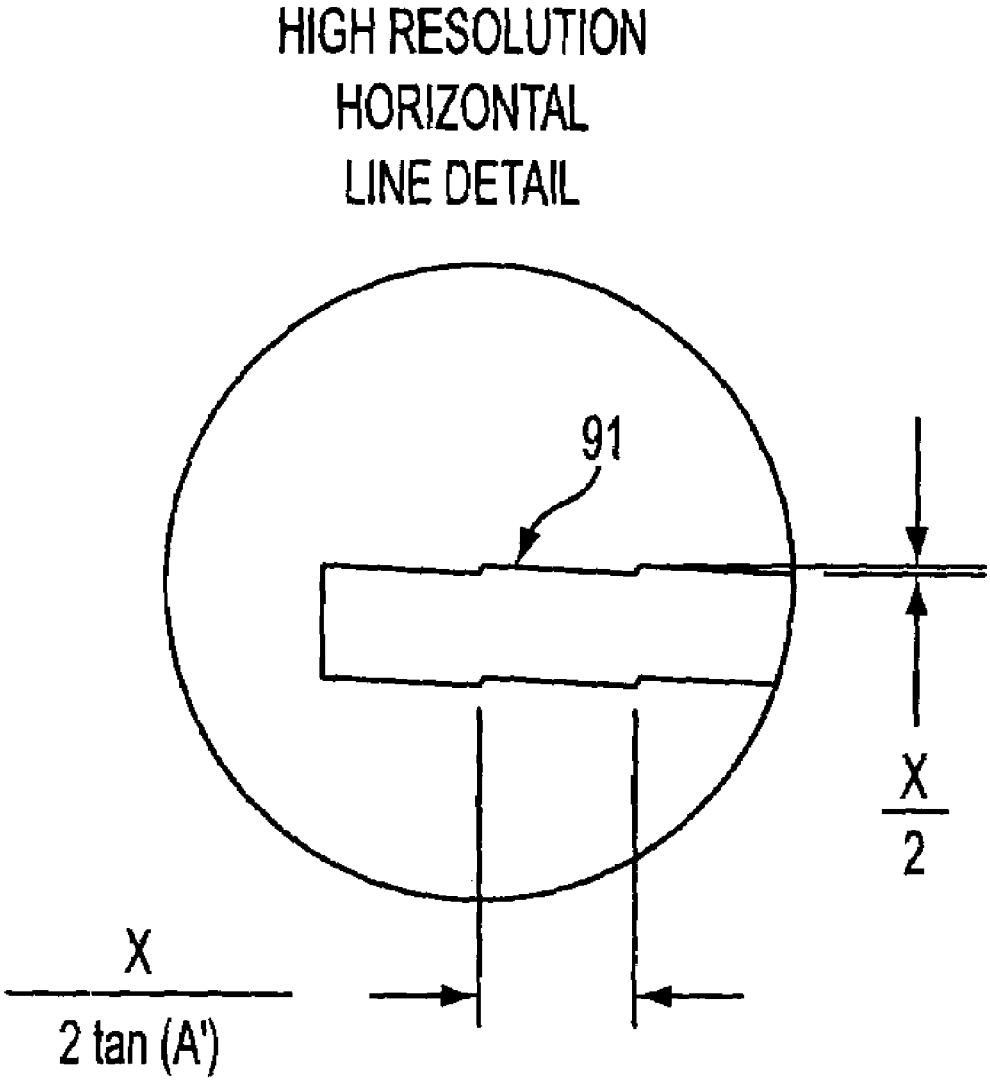
FIG. 21 is a diagram showing the aliasing produced by increasing the number of passes that the print head makes around the drum.

In a fourth preferred embodiment, an immediate print quality improvement of the first and second embodiments can be made by increasing the number of passes that the print heads 40 make around the drum 10, as shown in FIG. 20. In this case, the carriage only moves down the page a fraction of the swath width for each drum revolution. This technique is often used to achieve photographic quality. During each pass along carriage direction 82, the nozzles may be offset half of the distance X from the previous pass, effectively doubling the addressability of the system. The vertical shear algorithm 124 is changed to compensate for a different lead angle A', thus producing the corrected image 53. A detailed view of horizontal line 91 is shown in FIG. 21. The vertical aliasing defect is about half of the previous case, but the system throughput is also reduced to achieve this result.

In a fifth preferred embodiment a similar technique is used as with the first and second embodiments to achieve the highest possible print quality. A full drum rotation may be skipped between each print swath, and each swath may be printed with a zero lead angle (the carriage being stationary during printing). This again reduces the throughput, but would be acceptable for photographic quality printing applications. The technique may be required for ink drying or mixing considerations as well.

Figure 22:
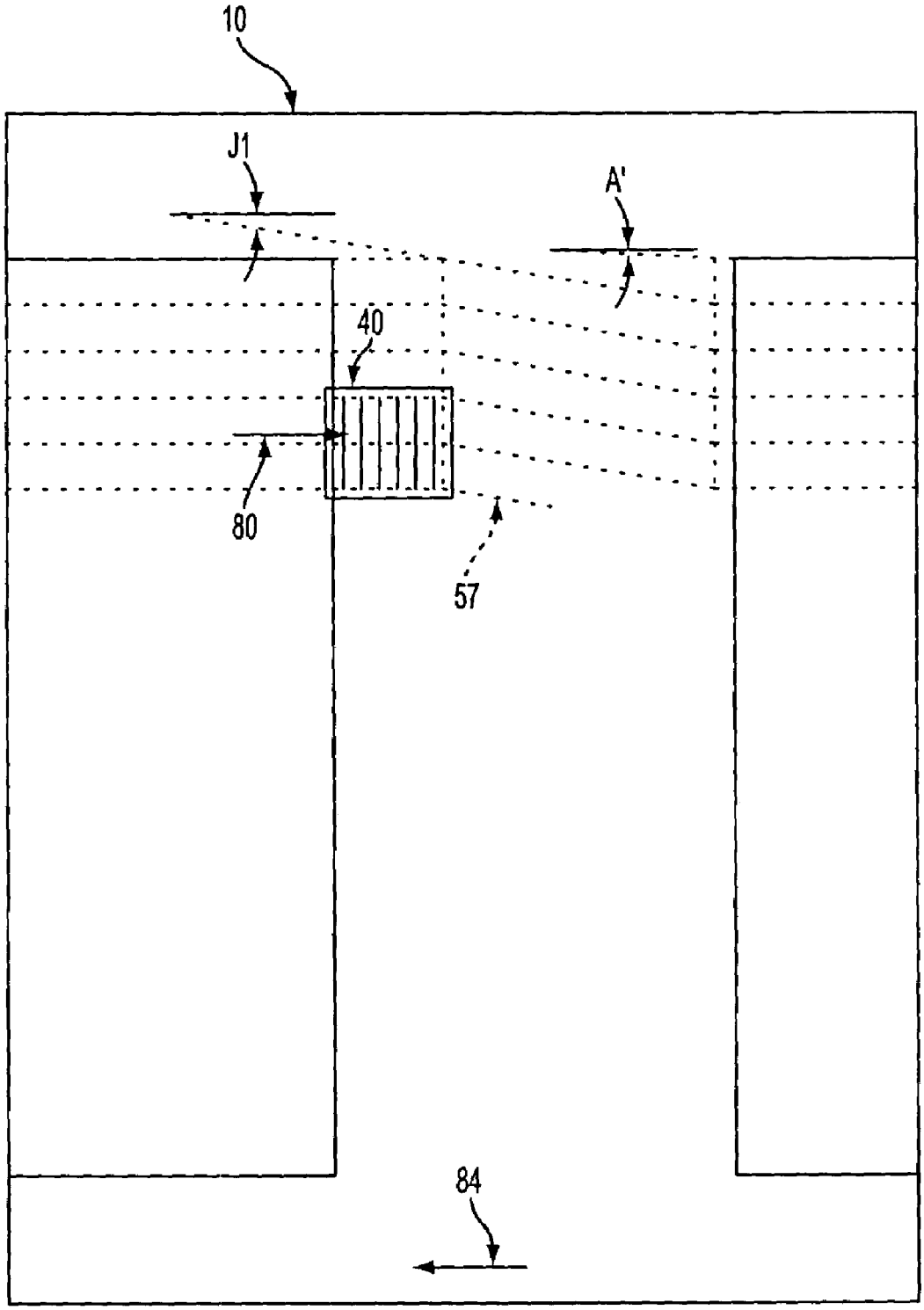
FIG. 22 is a diagram showing helical printing with zero angle.
Figure 23:
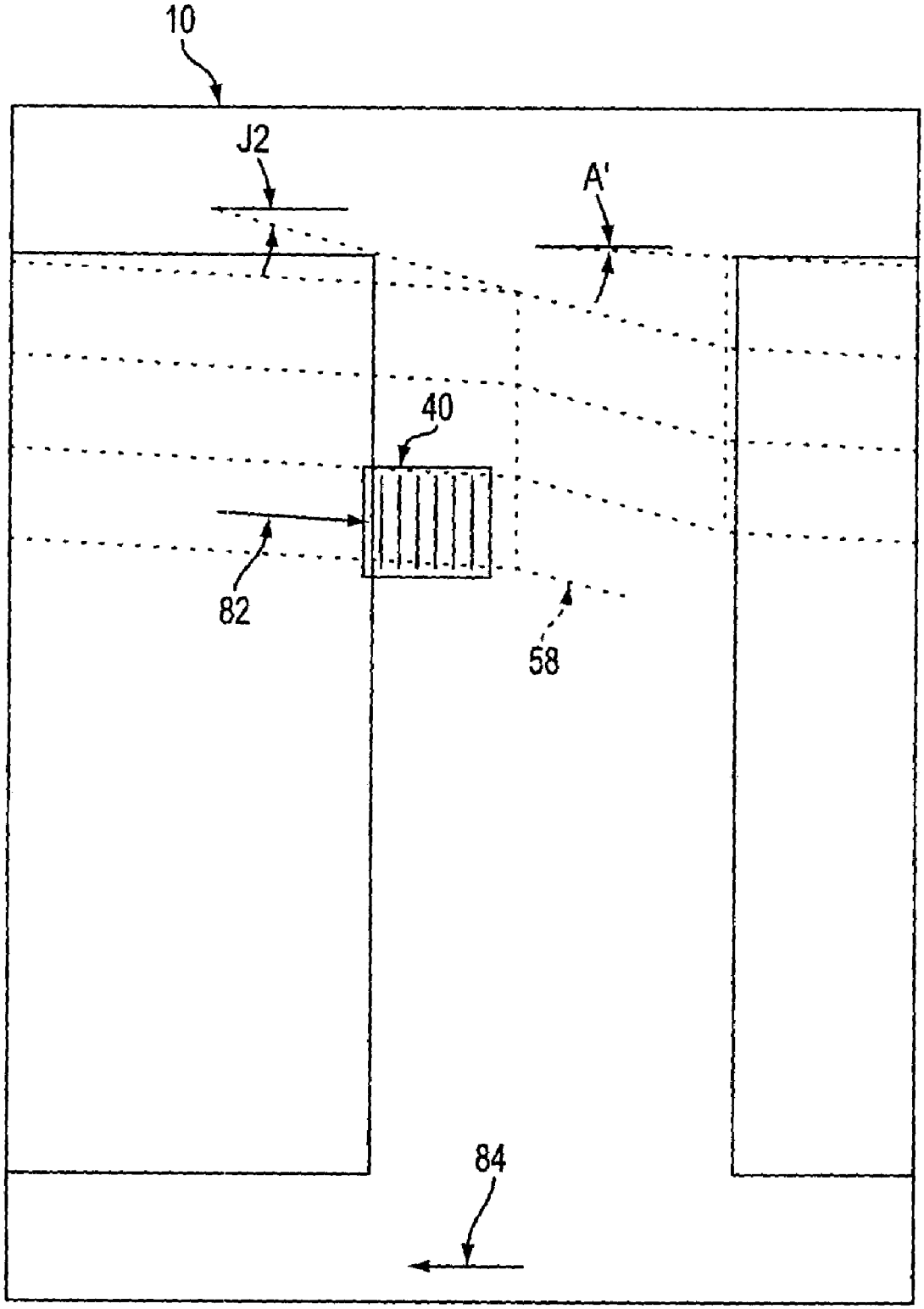
FIG. 23 is a diagram showing helical printing of large lead angles converted to smaller angles.
Figure 24:
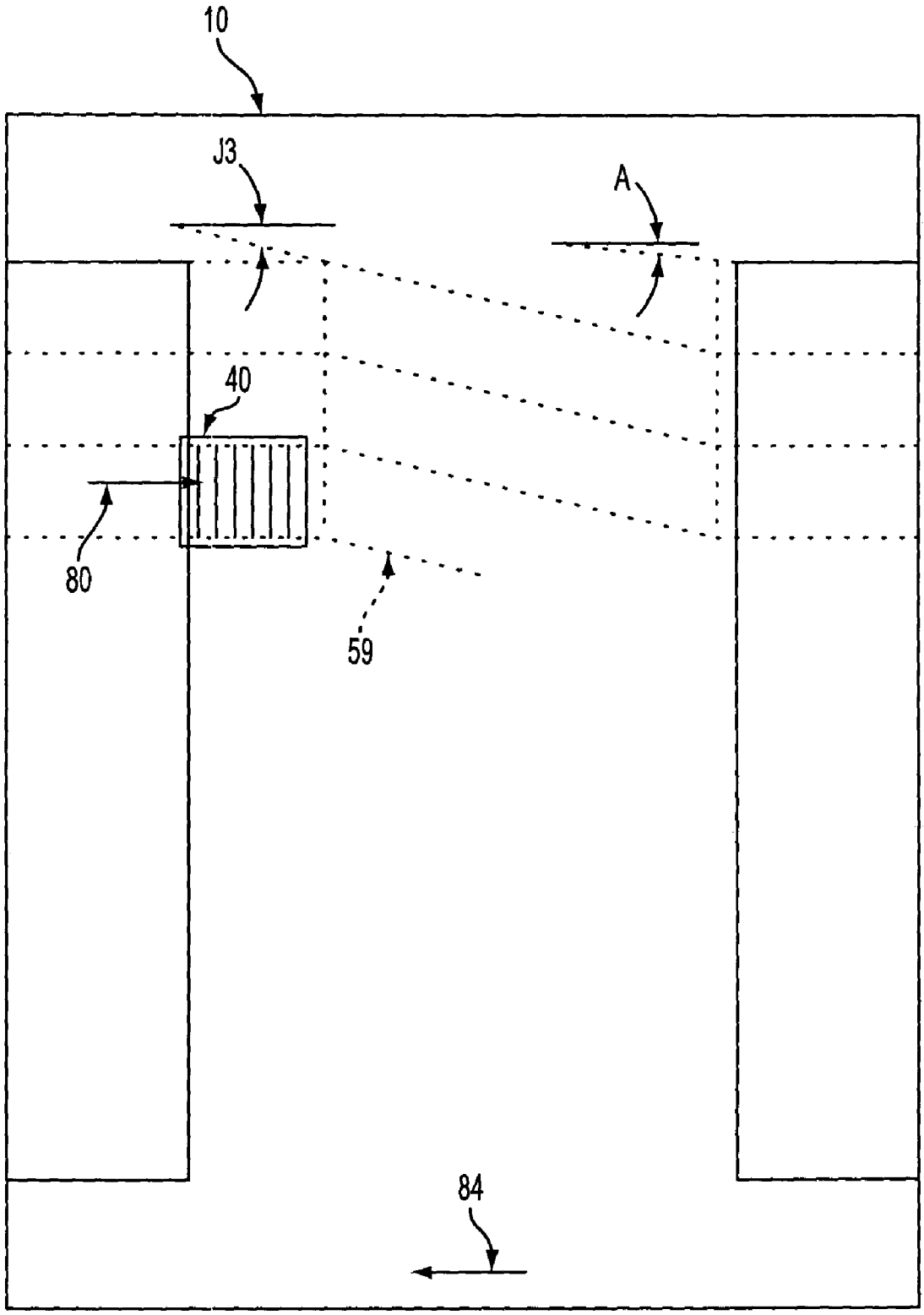
FIG. 24 is a diagram showing helical printing of large lead angles converted to zero angle.

In a sixth preferred embodiment, in addition to encompassing the features of the first and second embodiments, similar steps to improve print quality are used for narrow images which result in large gaps on the drum. As the length of path 56 of FIG. 6 or length of path 66 of FIG. 8 increase, several more alternatives are made possible. First, very small lead angles J1 can be eliminated, or rather, converted to a zero angle by angle A' as shown in FIG. 22. The swath to swath carriage movement along carriage direction 80 is then accomplished while the print head follows path 57. This technique provides the best print media alignment and image aliasing results. Larger lead angles J2 can be reduced to smaller angles A' if that improves quality as shown in FIG. 23. Large lead angles J3 can be converted to zero by angle A if the image is narrow enough to allow all carriage movement between image swaths while the print head follows path 59 as shown in FIG. 24.

In a seventh preferred embodiment, in addition to encompassing the features of the first and second embodiments, long blank areas in the vertical dimension are traversed at higher than normal rates by moving the print head carriage 30 at higher speeds during one or more drum revolutions while print heads 40 are idle.

In the preferred embodiments, the apparatus components and related method operations are integral. For example, if the drum circumference changes, the lead angles of interest are affected, which changes the image shear algorithms needed to create image 52 in FIG. 9 or image 60 in FIG. 11, and the nozzle placement of FIGS. 3 and 4.

The present invention has been described with reference to a number of different preferred embodiments. Sequences of a controller used in the method and apparatus for the first and second embodiments are presented to further emphasize the invention.

A controller, typically a processor, is connected to and thereby controls the interoperation of the different components and operations of the preferred embodiments. As discussed above, the controller additionally receives in data from the tachometer and optical grating and sensor to control carriage movement.

Figure 25:
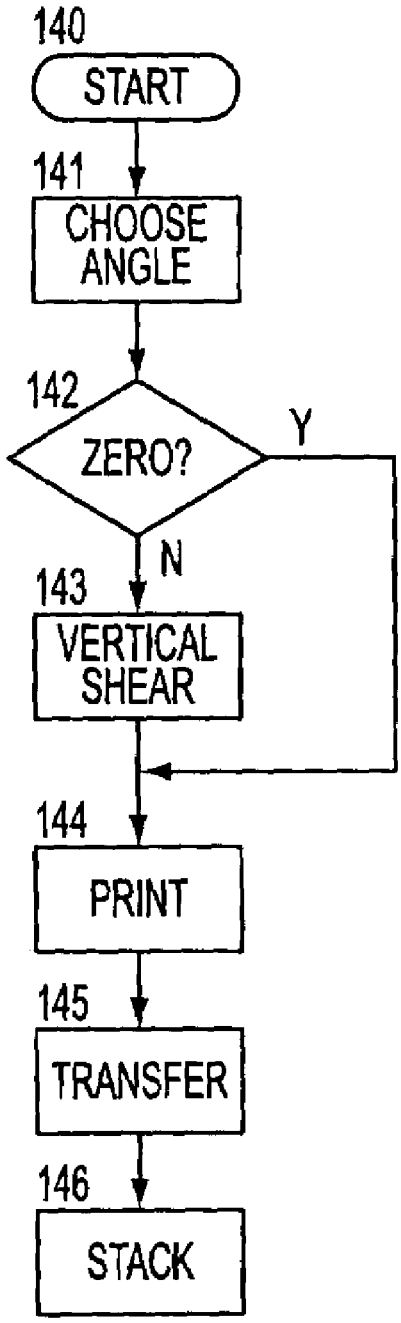
FIG. 25 is a flow chart showing the sequence of the controller according to a first preferred embodiment.

The first preferred embodiment, as previously disclosed, does not correct for the aliasing created by the skew corrections. The following listed sequences of operation of the controller for this first preferred embodiment is shown in FIG. 25.

1. Start sequence (140 in FIG. 25).
2. Choose the rotation angle for desired print quality (141 in FIG. 25).
3. Apply the vertical shear algorithm to the original image (142/143 in FIG. 25).
4. Print the image on the drum while receiving information from the tachometer, optical grating sensor, and drum heater (144 in FIG. 25).
5. Transfer the image onto the print medium (145 in FIG. 25).
6. Stack output (146 in FIG. 25).

Figure 26:
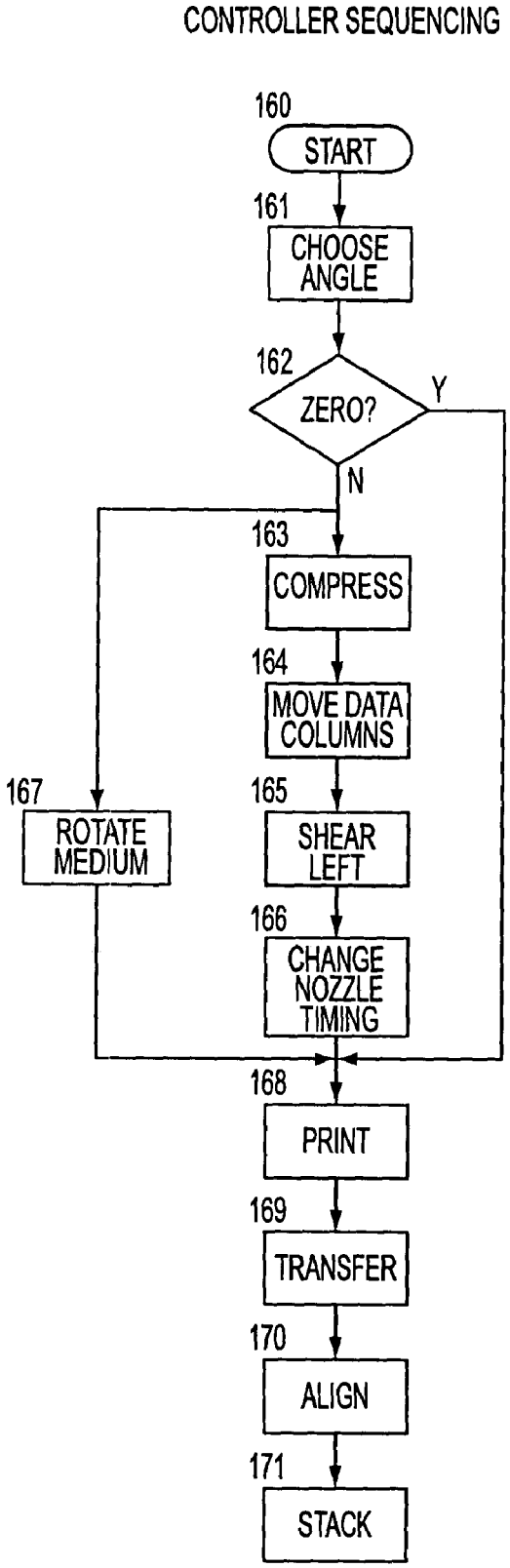
FIG. 26 is a flow chart showing the sequence of the controller according to a second preferred embodiment.

The second preferred embodiment, as previously disclosed, corrects for the aliasing created by the skew corrections. The following listed sequence of operation of the controller for this second preferred embodiment is shown in FIG. 26.

1. Start sequence (160 in FIG. 26).
2. Choose rotation angle, based on image width, type, and desired quality (161/162 in FIG. 26).
3. Compress the image in both dimensions by cos (A) (163 in FIG. 26).

4. Move the data within the image for proper nozzle column alignment (164 in FIG. 26).

5. Shear the image data to match lead angle A (165 in FIG. 26).

6. Change the nozzle driver timing to correct aliasing created by the algorithm (166 in FIG. 26).

7. Print on drum while receiving information from the tachometer, optical grating sensor, and heater (168 in FIG. 26).

8. Rotate print medium with respect to drum (167 in FIG. 26).

9. Transfer image to print medium (169 in FIG. 26).

10. Align print medium to paper path or output stack (170/171 in FIG. 26).

Although a few preferred embodiments of the present invention have been shown and described, it will be appreciated by those skilled in the art that changes may be made in these embodiments without departing from the principles and spirit of the invention, the scope of which is defined in the claims and their equivalents. For example, the preferred embodiments of the present invention have been shown and described without printing directly to a medium, rather the preferred embodiments print to a drum and thereafter transfer the image to the medium. However, other embodiments of the present invention may incorporate printing directly to a medium by placing the medium on the drum prior to printing. The present techniques for helical printing nozzle placement, skewing, and aliasing are applicable when printing directly to paper.

Additionally, the preferred embodiments of the present invention have been shown and disclosed as using a plurality of print heads. However, other embodiments could use only one print head, or multiple columns of nozzles on each print head for different colors of ink.

What is claimed is:

1. A method of helical ink-jet, drum printing, comprising:

calculating a helical lead angle for an image to be printed;

applying a shearing algorithm to the image to compensate for the calculated helical lead angle;

selecting nozzles having a moveable print head, to compensate for the calculated helical lead angle, said nozzles arranged in a plurality of columns, with the arranging of said nozzles further including arranging a first column set having a first column of nozzles and a second column of nozzles and offsetting the second column of nozzles from the first column of nozzles by a distance calculated from a minimum lead angle and the circumference of the drum, and the separation of nozzles within a column;

rotating the orientation of said image relative to the drum;

depositing ink in a helical pattern onto a drum from the selected nozzles synchronized with rotation of said drum;

rotating a medium capable of receiving ink from said drum relative to the rotation of said image prior to transferring the ink thereto; and transferring the ink from said drum to a separate medium after an entire image has been deposited onto said drum.

2. The method of helical ink-jet printing of claim 1, wherein calculating the lead angle is based on a speed of the rotation of the drum and a speed of movement of the moveable print head.

3. The method of helical ink-jet drum printing of claim 1, wherein the transferring of ink is performed while the ink is still wet by pressing the separate medium to the drum at a pressure between 2 and 10 psi.

4. The method of helical ink-jet printing of claim 1, further comprising measuring the speed of rotation of the drum.

5. The method of helical ink-jet printing of claim 1, further comprising measuring a speed of movement of the movable print head.

6. An ink-jet printer, comprising:

a drum fabricated of a material which is impervious to ink, said drum being rotated upon activation of the ink-jet drum printer;

an ink-jet print head having a plurality of nozzles arranged in a plurality of columns and movable parallel to the axis of rotation of the drum;

a first column set, said first column set having a first column of nozzles and a second column of nozzles and offsetting the second column of nozzles from the first column of nozzles by a distance calculated from a minimum lead angle and the circumference of the drum, and the separation of nozzles within a column;

additional column sets, said additional column set offset from each other by a distance calculated from the minimum lead angle and the separation of nozzles within a column; and a controller, connected to the ink-jet print head, causing the ink-jet print head at the outset of printing to move at a constant predetermined speed, calculating a helical lead angle based on a speed of rotation of the drum and a speed of movement of the ink-jet print head, and selecting nozzles of the plurality of nozzles to compensate for the helical lead angle and to deposit ink on the drum, and compressing the dimensions of an image prior to printing the image on said drum by depositing said ink.

7. The ink-jet drum printer of claim 6, wherein the controller further applies a shearing algorithm to an image prior to printing the image on the drum by depositing the ink.

8. The ink-jet drum printer of claim 7, wherein the controller further causes a medium to rotate prior to applying the medium to a drum to transfer the deposited ink thereto, and controls the timing of the plurality of nozzles to correct for aliasing created by the shearing algorithm.

9. The ink-jet drum printer of claim 6, further comprising a medium applied to the drum to receive the deposited ink.

* * * * *